US012560059B2

(12) United States Patent
Wang et al.

(10) Patent No.: US 12,560,059 B2
(45) Date of Patent: Feb. 24, 2026

(54) GAS LIFT LATCH

(71) Applicant: Schlumberger Technology Corporation, Sugar Land, TX (US)

(72) Inventors: Chao Wang, Rosharon, TX (US); Shao Chong Oh, Singapore (SG); Jason Kamphaus, Rosharon, TX (US); Ganesh Balasubramanian, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 95 days.

(21) Appl. No.: 18/697,807

(22) PCT Filed: Nov. 18, 2022

(86) PCT No.: PCT/US2022/050464
§ 371 (c)(1),
(2) Date: Apr. 2, 2024

(87) PCT Pub. No.: WO2023/091705
PCT Pub. Date: May 25, 2023

(65) Prior Publication Data

US 2025/0237124 A1 Jul. 24, 2025

Related U.S. Application Data

(60) Provisional application No. 63/264,331, filed on Nov. 19, 2021.

(51) Int. Cl.

| | |
|---|---|
| ***E21B 23/02*** | (2006.01) |
| ***E21B 23/03*** | (2006.01) |
| ***E21B 43/12*** | (2006.01) |

(52) U.S. Cl.
CPC ..... *E21B 43/123* (2013.01); *E21B 23/02* (2013.01); *E21B 23/03* (2013.01)

(58) Field of Classification Search
CPC ..... E21B 23/02; E21B 23/03; E21B 43/123
See application file for complete search history.

(56) References Cited

U.S. PATENT DOCUMENTS

| | | | |
|---|---|---|---|
| 3,074,485 | A | 1/1963 | Mcgown, Jr. |
| 3,638,988 | A | 2/1972 | Brown |
| 3,741,601 | A | 6/1973 | Dudley |
| 3,827,493 | A | 8/1974 | Terral |
| 3,863,961 | A | 2/1975 | Dinning |
| 3,874,447 | A | 4/1975 | Mcgowen, Jr. |
| 3,874,448 | A | 4/1975 | Mcgowen, Jr. |
| 4,265,360 | A | 5/1981 | Khodos |
| 4,379,488 | A | 4/1983 | Hamm |
| 4,454,972 | A | 6/1984 | Maltby, Jr. |
| 4,554,972 | A | 11/1985 | Merritt |

(Continued)

FOREIGN PATENT DOCUMENTS

| | | |
|---|---|---|
| EP | 0325835 A1 | 8/1989 |

*Primary Examiner* — Tara Schimpf
*Assistant Examiner* — Lamia Quaim
(74) *Attorney, Agent, or Firm* — Jeffrey D. Frantz

(57) ABSTRACT

Latch designs for downhole components are provided. Some latch designs automatically lock in place in a mandrel pocket, for example automatically lock on or relative to both the no-go up and no-go down shoulders of the mandrel, when set. The latch designs reduce the range of movement of the latch within the mandrel pocket.

18 Claims, 25 Drawing Sheets

(56) References Cited

U.S. PATENT DOCUMENTS

| | | | | |
|---|---|---|---|---|
| 5,058,670 | A | 10/1991 | Crawford | |
| 5,205,357 | A | 4/1993 | Terral | |
| 2006/0137881 | A1 | 6/2006 | Schmidt | |
| 2010/0044055 | A1* | 2/2010 | Pena | E21B 43/123 166/216 |
| 2023/0392463 | A1 | 12/2023 | Kamphaus | |

* cited by examiner

GAS LIFT LATCH

CROSS-REFERENCE TO RELATED APPLICATIONS

The present application is a National Stage Entry of International Application No. PCT/US2022/050464, filed Nov. 18, 2022, which claims priority benefit of U.S. Provisional Application No. 63/264,331, filed Nov. 19, 2021, the entirety of which is incorporated by reference herein and should be considered part of this specification.

BACKGROUND

Field

The present disclosure generally relates to gas lift, and more particularly to a latch design for downhole tools.

Description of the Related Art

Oil and gas wells utilize a borehole drilled into the earth and subsequently completed with equipment to facilitate production of desired fluids from a reservoir. Subterranean fluids, such as oil, gas, and water, are produced from the wellbore. In some cases, the fluid is produced to the surface naturally by downhole formation pressures. However, the fluid must often be artificially lifted from wellbores by the introduction of downhole equipment. Various types of artificial lift are available. In a gas lift system, a compressor is located on the surface. The compressor pumps gas down the casing tubing annulus. The gas is then released into the production tubing via gas valves that are strategically placed throughout the production tubing. The gas that is introduced lightens the hydrostatic weight of the fluid in the production tubing, allowing the reservoir pressure to lift the fluid to surface.

SUMMARY

In some configurations, a latch for a downhole component includes a latch stop forming a base of the latch; a running head coupled to and extending upward from the latch stop; a latch body circumferentially disposed about at least a portion of the running head; a latch ring disposed circumferentially about the latch body and positioned adjacent the latch stop; a dog assembly comprising a shaft disposed radially between the running head and the latch body and one or more dogs disposed at a bottom end of the shaft, the dogs configured to engage corresponding features in the running head; and a lock ring disposed circumferentially about the latch body, wherein in a locked position, the lock ring is positioned at an axial position along the latch body such that the lock ring is radially aligned and disposed about the one or more dogs, the lock ring configured to inhibit the one or more dogs from moving radially outward out of engagement with the corresponding features in the running head, and wherein in an unlocked position, the lock ring is positioned along the latch body axially spaced from the one or more dogs, thereby allowing the one or more dogs to move radially outward out of engagement with the running head.

The latch body can include a locking mechanism configured to engage the lock ring in the unlocked position. The latch can include a safety mechanism positioned along the running head above the latch body.

In some configurations, a method for retrieving the latch coupled to a downhole component from a mandrel disposed in a wellbore includes running a pulling tool downhole to contact the latch; pushing the lock ring downward along the latch body to the unlocked position using the pulling tool; and allowing the one or more dogs to move radially outward out of engagement with the running head.

The method can include using the pulling tool to pull upward on the latch body, driving the one or more dogs radially outward. The method can include pulling the latch body and dog assembly upward such that the latch body disengages from and clears the latch ring, allowing the latch ring to move radially inward out of engagement with a lug of the mandrel. The method can include removing the latch and downhole component from the mandrel and wellbore.

In some configurations, a latch for a downhole component includes: a latch stop, the latch stop comprising a no go down shoulder on an outer surface of the latch stop and an undercut at least partially defined by an inner surface of the latch stop and extending downward from a top surface of the latch stop; a running head coupled to and extending upward from the latch stop; a latch body circumferentially disposed about at least a portion of the running head; and a latch ring disposed circumferentially about the latch body. The latch body is configured to slide axially relative to the running head during installation of the latch such that a lower portion of the latch body slides into the undercut.

The latch ring is disposed adjacent the top surface of the latch stop. The undercut can be machined into the top surface of the latch stop. The latch stop can include a sleeve disposed about a portion of the running head. The latch stop and running head can be integrally formed. The running head can include a base and a post extending upward from the base. The latch stop can be coupled to the base of the running head. The running head can at least partially define and bound the undercut. The undercut can be at least partially defined and bounded by an inner surface of the latch stop and an outer surface of the running head. When the latch body slides into the undercut, a clearance may be formed between a bottom of the latch body and a base of the undercut.

The latch can further include a shear pin extending transversely through the running head. The latch body can include a slot extending axially along a portion of a length of the latch body, with an end of the shear pin disposed in the slot. As the latch body slides axially relative to the running head during installation, the shear pin is configured to slide axially within and relative to the slot. The latch can include a cutout in an outer surface of the latch body. As the latch body slides axially into the undercut during installation, the cutout is configured to move into alignment with the latch ring and the latch ring is configured to collapse into the cutout to enable the latch ring to clear a lug of a mandrel into which the latch is installed. A spring can be disposed circumferentially about the latch body and extending axially from a top of the latch ring to a bottom of a flange of the latch body or of a latch stopper disposed about the latch body.

A method of installing the latch into a mandrel in a wellbore can include: sliding the latch body axially such that the lower portion of the latch body slides into the undercut, thereby compressing the spring and allowing the latch ring to collapse into the cutout; pushing the latch into a pocket of the mandrel until stopped by contact of the no-go down shoulder of the latch stop with a no go down shoulder at a bottom of the pocket; and releasing the latch body such that the spring biases the latch body out of the undercut, thereby pushing the latch ring radially outwardly into the pocket such that upward movement of the latch is stopped by contact of an upper surface of the latch ring with a no go up shoulder at a top of the pocket.

A method of retrieving the latch from a mandrel in a wellbore can include pulling up on the latch body to move the latch body relative to the running head, thereby shearing the shear pin and allowing the latch ring to collapse; and pulling up on the latch such that the latch ring clears a lug of the mandrel.

In some configurations, a latch for a downhole component includes: a latch stop comprising a no go down shoulder on an outer surface of the latch stop; a running head coupled to and extending upward from the latch stop; a latch body circumferentially disposed about at least a portion of the running head; and a latch ring disposed circumferentially about the latch body and axially adjacent a top of the latch stop. A distance from the no go down shoulder of the latch stop to an upper surface of the latch ring is approximately the same as an axial length of a pocket of a mandrel into which the latch is installed.

When the latch is installed in the mandrel, contact of the no go down shoulder of the latch with a no go down shoulder of the mandrel and contact of the upper surface of the latch ring with a no go up shoulder of the mandrel is configured to prevent or minimize movement of the latch relative to the mandrel during use. During installation, the latch ring remains axially adjacent the top of the latch stop.

BRIEF DESCRIPTION OF THE FIGURES

Certain embodiments, features, aspects, and advantages of the disclosure will hereafter be described with reference to the accompanying drawings, wherein like reference numerals denote like elements. It should be understood that the accompanying figures illustrate the various implementations described herein and are not meant to limit the scope of various technologies described herein.

DETAILED DESCRIPTION

In the following description, numerous details are set forth to provide an understanding of some embodiments of the present disclosure. It is to be understood that the following disclosure provides many different embodiments, or examples, for implementing different features of various embodiments. Specific examples of components and arrangements are described below to simplify the disclosure. These are, of course, merely examples and are not intended to be limiting. However, it will be understood by those of ordinary skill in the art that the system and/or methodology may be practiced without these details and that numerous variations or modifications from the described embodiments are possible. This description is not to be taken in a limiting sense, but rather made merely for the purpose of describing general principles of the implementations. The scope of the described implementations should be ascertained with reference to the issued claims.

As used herein, the terms "connect", "connection", "connected", "in connection with", and "connecting" are used to mean "in direct connection with" or "in connection with via one or more elements"; and the term "set" is used to mean "one element" or "more than one element". Further, the terms "couple", "coupling", "coupled", "coupled together", and "coupled with" are used to mean "directly coupled together" or "coupled together via one or more elements". As used herein, the terms "up" and "down"; "upper" and "lower"; "top" and "bottom"; and other like terms indicating relative positions to a given point or element are utilized to more clearly describe some elements. Commonly, these terms relate to a reference point at the surface from which drilling operations are initiated as being the top point and the total depth being the lowest point, wherein the well (e.g., wellbore, borehole) is vertical, horizontal or slanted relative to the surface.

Figure 1:
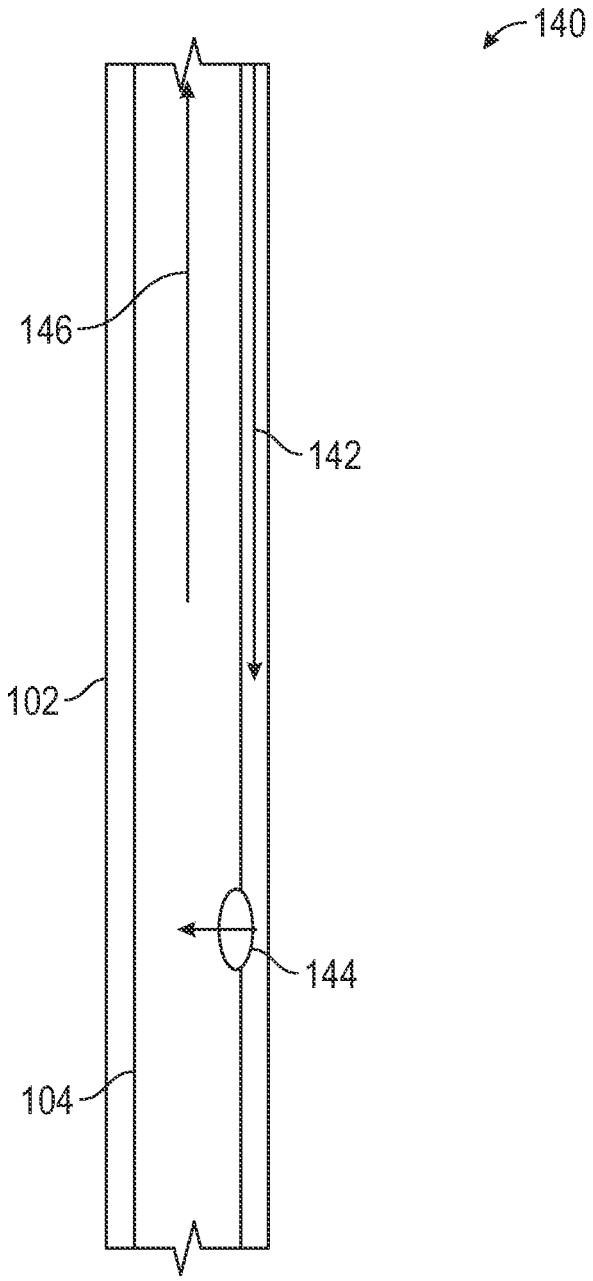
FIG. 1 schematically illustrates a portion of an example gas lift system.

FIG. 1 schematically illustrates a downhole portion of an example gas lift system 140. The gas lift system 140 includes a compressor located at the well surface. In use, the compressor pumps gas down the annulus between the casing 102 and the tubing 104, as indicated by arrow 142. The gas is then released into the tubing 104 via one or more gas valves 144 that are strategically placed throughout the tubing 104. The gas lessens the hydrostatic weight of the fluid in the tubing 104, allowing the reservoir pressure to lift the fluid to the surface, as indicated by arrow 146.

The present disclosure provides a latch for downhole tools. Latches according to the present disclosure can be used in gas lift. However, the latches can also be used in various other applications, for example, in any case in which a latch is needed to aid in conveyance, to prevent a tool from dislodging during operations, and/or to aid in retrieval of the tool.

A gas lift latch secures the gas lift valve in the gas lift mandrel pocket bore in the well. Gas lift latches ensure that during operation the valve remains in the pocket bore and does not get displaced out due to pressure differentials or mechanical loads. This is accomplished through a latching ring that secures in a recess behind the mandrel pocket lug. The latches also interface with slickline running and pulling tools, and through suitable shearing mechanisms allow easy installation and retrieval of the gas lift valve from the mandrel pocket bore through slickline or wireline operation.

Figure 2:
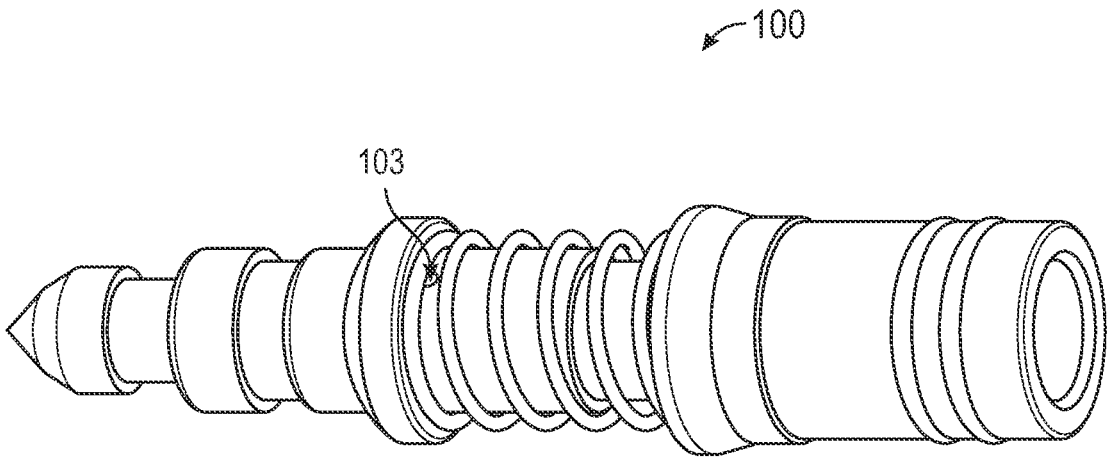
FIG. 2 illustrates a perspective view of an example existing latch.
Figure 3B:
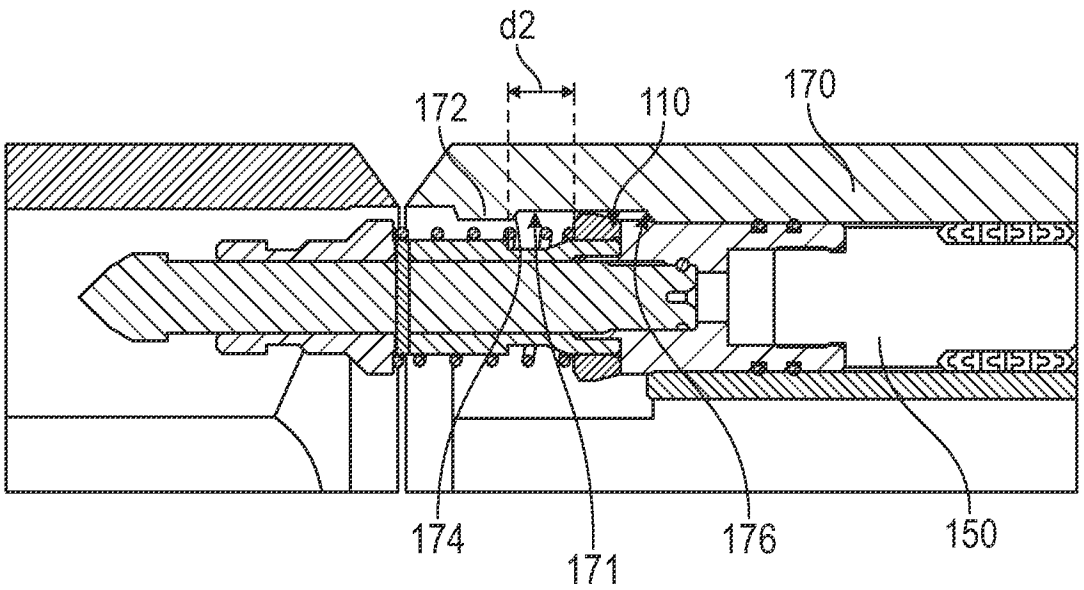
FIGS. 3A-3B illustrate a longitudinal cross-section of an assembly including the latch of FIG. 2 and a valve.
Figure 3A:
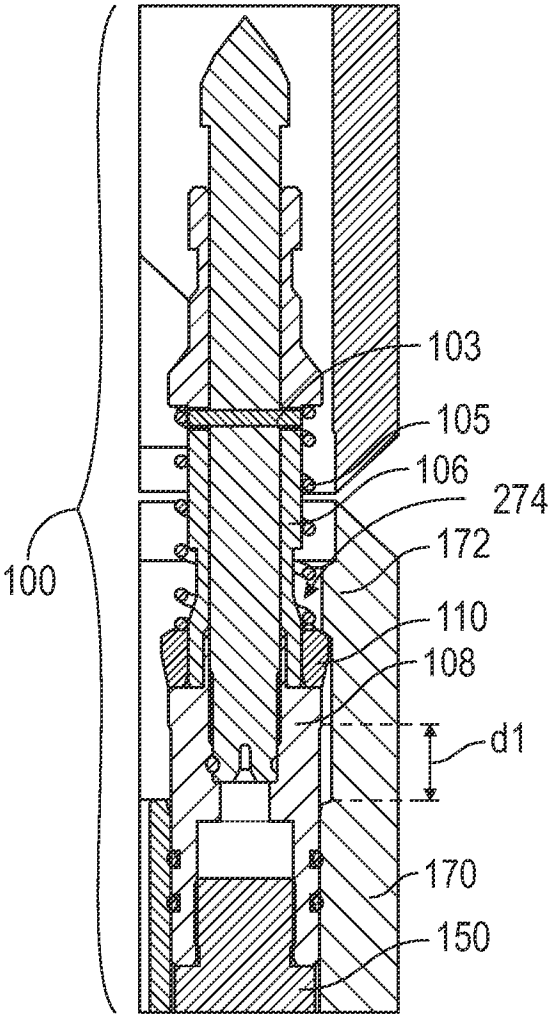
Figure 4:
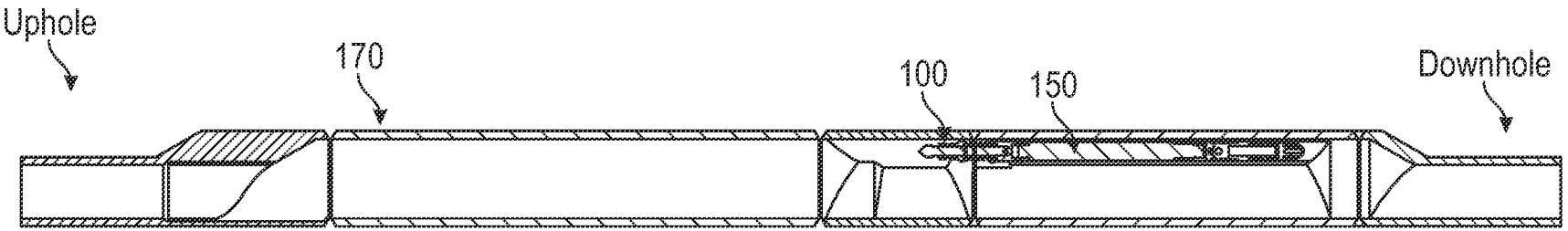
FIG. 4 illustrates a longitudinal cross-section of the valve and latch assembly of FIG. 3 disposed in a mandrel.

FIGS. 2-4 illustrate a standard latch design. The latch 100 is configured to be coupled to a downhole component, such as a valve 150 as shown in the configuration of FIGS. 3A-3B. In use, the assembly of the latch 100 and downhole component, e.g., the valve 150 in the illustrated configuration, can be disposed in a mandrel 170, for example as shown in FIG. 4. The latch 100 can move up and down by the range of movement distance d1 or clearance gap distance d2 shown in FIGS. 3A-3B, which is determined by features of the latch 100 and mandrel 170. For example, the mandrel 170 can include a lug 172 protruding inwardly from an inner surface of the mandrel 170, as shown in FIGS. 3A-3B. A lower edge of the lug forms a no go up shoulder 174. A pocket in the inner surface extends downward from the no go up shoulder 174 to a no go down 176 shoulder formed by a surface or feature of the inner surface of the mandrel 170. When deployed, features of the latch 100 are disposed in the pocket. The range of movement d1 is defined by the distance the latch 100 can travel between a point at which a feature of the latch 100 contacts the no go up shoulder 174 and stops further upward movement (as shown in FIG. 3A), and a point at which a feature of the latch 100 contacts the no go down shoulder 176 and stops further downward movement (as shown in FIG. 3B).

The range of movement allows the latch 100 and component (e.g., valve 150) assembly to accelerate, for example as the assembly is conveyed into the well and the mandrel 170, until the latch ring 110 impacts the mandrel lug 172, resulting in dynamic loading of the shear pin 103. The clearance gap is needed to allow the latch ring 110 of the latch to maneuver into the locked position during installation. However, reversals in differential pressure between the annulus and tubing can cause the latch 100 to move up and down or shuttle rapidly within the range of movement d1, which may be undesirable. Shuttling can cause the shear pin 103 to shear prematurely, rendering the gas lift valve 150 unsecured. Additional pressure reversals can displace the gas lift valve 150 from the mandrel pocket bore, resulting in the well losing its integrity as the tubing and annulus zones now start to communicate.

The present disclosure provides latch designs that minimize or reduce the clearance gap d2 or the relative range of movement d1, d2 between the latch (e.g., a latch ring 110 of the latch) and the mandrel 170 (e.g., the mandrel lug 172). Latches 200 according to the present disclosure can be used with, for example, gas lift valves.

Some latches 200 according to the present disclosure can be installed via the same process as a standard latch (for example as shown in FIGS. 2-4) with a running tool. Some latches 200 according to the present disclosure (for example, as shown in FIGS. 5-6B, 7, and 8) replace the shear pin 103 of the standard latch with a dog or collet assembly 220. Compared to the shear pin 103, the dog or collet assembly 220 is more robust and can withstand higher mechanical loads and cyclic loading, which could cause the shear pin 103 to fail.

Figure 5:
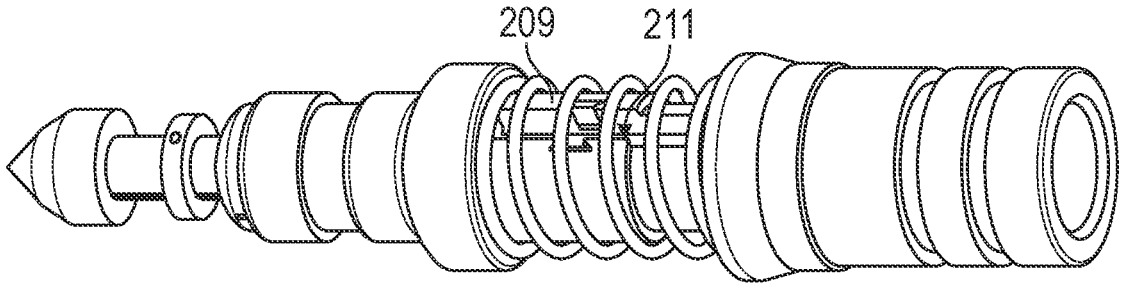
FIG. 5 illustrates a perspective view of an example latch according to the present disclosure.
Figure 6B:
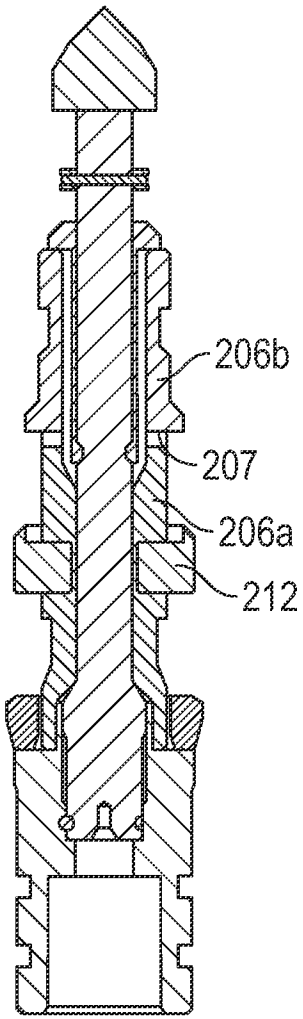
FIG. 6B illustrates a longitudinal cross-section of the latch of FIG. 5 in an unlocked position, with a spring element removed for clarity.

An example configuration of a latch 200 according to the present disclosure, shown in FIGS. 5-6B, includes an outer latch body 206, a running head 202, a latch ring 210, a latch stop 208, a lock ring 212, and a dog assembly 220. The latch stop 208 can form a base or bottom of the latch 200. For use, a downhole component, such as a valve 150, can be partially received in and/or secured to the latch stop 208. The running head 202 is disposed within (radially within) and extends through (longitudinally or axially through) the latch body 206. A lower end or portion of the running head 202 can extend into and/or be coupled to the latch stop 208. A lower end or portion 206*a* of the latch body 206 can be coupled to and/or disposed adjacent the latch stop 208. The latch ring 210 is disposed about (radially or circumferentially about) the latch body 206. The latch ring 210 can be positioned at, adjacent, or proximate a lower or downhole end of the latch body 206. In the illustrated configuration, the latch ring 210 is disposed adjacent and/or contacts a portion of the latch stop 208. As shown, the latch body 206 can include an upper portion 206*b* and a lower portion 206*a*. The upper 206*b* and lower 206*a* portions can be integrally formed or one piece, or can be separate pieces coupled together. A lower or downhole facing edge of the upper portion 206*b* can form a shoulder 207 (shown in FIG. 6B). A spring 205 is disposed radially or circumferentially about the lower portion 206*a*.

Figure 6A:
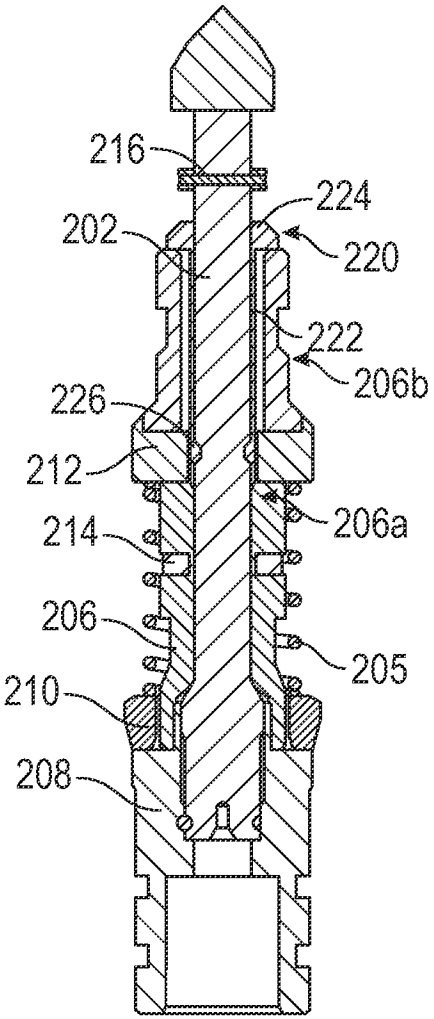
FIG. 6A illustrates a longitudinal cross-section of the latch of FIG. 5 in a locked position.

In some configurations, for example as shown in FIGS. 6A-8, the latch includes a locking mechanism 214 positioned along an outer surface of the lower portion 206*a*. Some configurations lack a locking mechanism 214, for example as shown in the configuration of FIG. 9. In some configurations, as shown in FIGS. 6A-6B, the latch includes a safety mechanism 216 positioned along or about the running head 202 above the latch body 206. The configurations of FIGS. 7-9 do not include a safety mechanism 216.

The dog assembly 220 includes a shaft or body 222 disposed radially between the latch body 206 (e.g., upper portion 206*b*) and the running head 202. In some configurations, the dog assembly 220 is assembled with the latch body 206. The latch body 206 and dog assembly 220 can be held together, for example with a pin. An upper or uphole end of the shaft 222 can include or form a flange 224 that has a greater diameter or extends radially outward beyond or to a greater extent than a remainder of the shaft 222. As shown, the flange 224 can be positioned above and outside of the latch body 206 and can be positioned adjacent or proximate an upper or uphole end of the latch body 206. In other configurations, for example as shown in FIG. 9, the flange 224 is disposed radially within, and does not extend above, the latch body 206. An upper edge or surface of the flange 224 can be flush with the upper end of the latch body 206 as shown, or may be recessed below the upper end of the latch body 206. The flange 224 can help secure the dog assembly 220 relative to the latch body 206. A lower or downhole end of the shaft 222 includes or forms one or more dogs 226 protruding radially inward from and relative to an inner surface of the shaft 222. The dogs 226 are sized, shaped, positioned, and/or configured to engage the running head 202, for example, corresponding features in an outer surface of the running head 202.

The lock ring 212 is disposed about (radially or circumferentially about) the latch body 206, for example, the lower portion of the latch body 206 in the illustrated configuration. The lock ring 212 can be formed as a single piece, for example as shown in FIG. 6A-6B, or multiple pieces, for example as shown in FIG. 9. In some configurations, a majority of the lower portion 206*a* of the latch body 206 can have a reduced diameter compared to the upper portion 206*b*. The lower portion 206*a* can include one or more rails 209 (shown in FIG. 5). In some configurations, the rails 209 project outwardly from and have a greater axial width than the majority of the lower portion 206*a*. The lock ring 212 can have one or more corresponding channels or features formed in its inner surface and configured to receive and slide along the rail(s) 209.

The dog assembly shaft 222 can be longer than the upper portion 206*b* such that the dogs 226 extend beyond and are positioned below the upper portion 206*b*. The lower portion 206*a* can include one or more longitudinally extending channels 211 (shown in FIG. 5) circumferentially aligned with or in the area of the dogs 226. The lock ring 212 can include corresponding projections (or radially thicker portions) extending inwardly from the inner surface of the lock ring 212, for example, into the channels 211. In some configurations, the projections prevent or inhibit the dogs 226 from moving or flexing too far radially outward and/or leaving the corresponding features in the running head 202 when the lock ring 212 is in a locked position. In some configurations, the lock ring 212 contacts the dogs 226. The spring 205 can extend between and contact the latch ring 210 and the lock ring 212.

In use, for example, during installation and/or operation of the valve 150, movement of the latch and valve assembly is transferred to force on the latch 200, with the load path through the dog assembly 220 (compared to the shear pin 103 in the design of FIGS. 2-4). In a locked position, the lock ring 212 is positioned longitudinally aligned with and radially or circumferentially about the dogs 226, as shown in FIG. 6A. In the locked position, the lock ring 212 keeps the dog(s) 226 engaged with corresponding features in the running head 202. This arrangement advantageously provides increased robustness and allows the latch to withstand greater forces and more cycles than a traditional shear pin design.

To retrieve the latch and valve assembly, a pulling tool pushes the lock ring 212 down, for example past the locking mechanism 214 if present, during a standard "jar down" process. In some configurations, features of the lock ring 212 (for example, on or in the inner surface of the lock ring 212) engage corresponding features of the locking mechanism 214 to retain the lock ring 212 in an unlocked position, shown in FIG. 6B (with the spring 205 removed for clarity). With the lock ring 212 in the unlocked position, the dogs 226 are able to move or flex radially outward and disengage from the running head 202. The pulling tool pulls upward on the latch body 206, driving the dogs 226 outward and allowing the latch body 206 and dog assembly 220 move upward together, for example, relative to the running head 202. When the latch body 206 is supporting (e.g., underlies or is radially aligned with) the latch ring 210, the valve and latch assembly is kept latched into the mandrel 170. When the latch body 206 moves upward enough to disengage from and clear (rise above) the latch ring 210, the unsupported latch ring 210 can move or contract toward the inner diameter of the latch and away from the mandrel lug 172, thereby releasing the valve and latch assembly from the mandrel 170.

In some configurations including the safety mechanism 216, with the lock ring 212 in an unlocked position, the latch body 206 and dog assembly 220 move upward until they shoulder against the safety mechanism 216. Further pulling with the pulling tool shears a shear pin in the safety mechanism 216, allowing the latch body 206 to move far enough upward to fully disengage from the latch ring 210 and release the valve and latch assembly.

Figure 7:
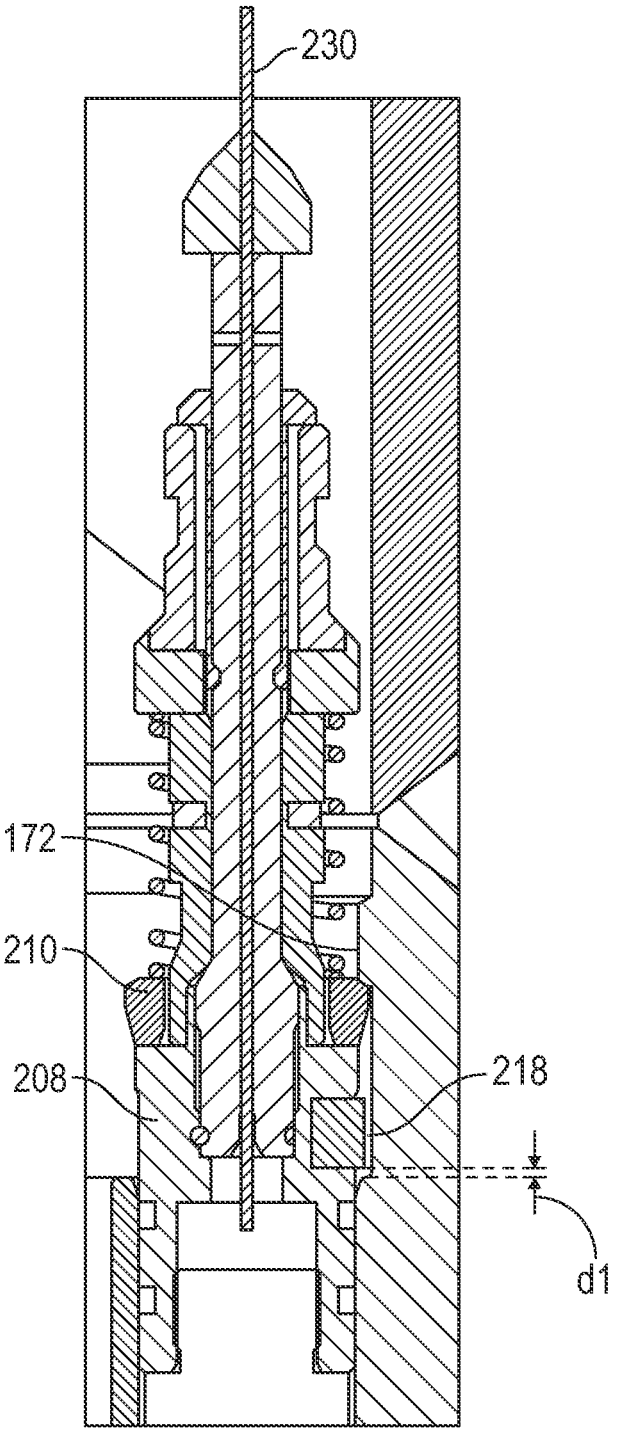
FIG. 7 illustrates a longitudinal cross-section of another example latch according to the present disclosure.

FIG. 7 illustrates another configuration of a latch according to the present disclosure that can share or include some or all of the features shown in and described with respect to FIGS. 5-6B. The configuration of FIG. 7 includes one or more locking dogs 218 disposed in or on or coupled to the latch stop 208, and an operating rod 230 extending longitudinally through the running head 202 and extending out of the top of the latch. During installation of the latch and downhole component (e.g., valve), the locking dogs 218 are held internally in the latch stop 208 or held in a retracted position. Once the latch and valve assembly is installed and held in place in the mandrel 170 by the latch ring 210 engaging or contacting the mandrel lug 172, the installation tool pulls on the operating rod 230. Pulling the operating rod 230 releases the locking dog(s) 218 into an expanded or deployed position in which the locking dog(s) 218 extend into an annular space between the mandrel and the latch. The locking dog(s) 218 help significantly reduce the range of movement d1 allowed, for example during dynamic pressure changes. This reduction in the range of movement reduces impact loads on the latch.

Figure 8:
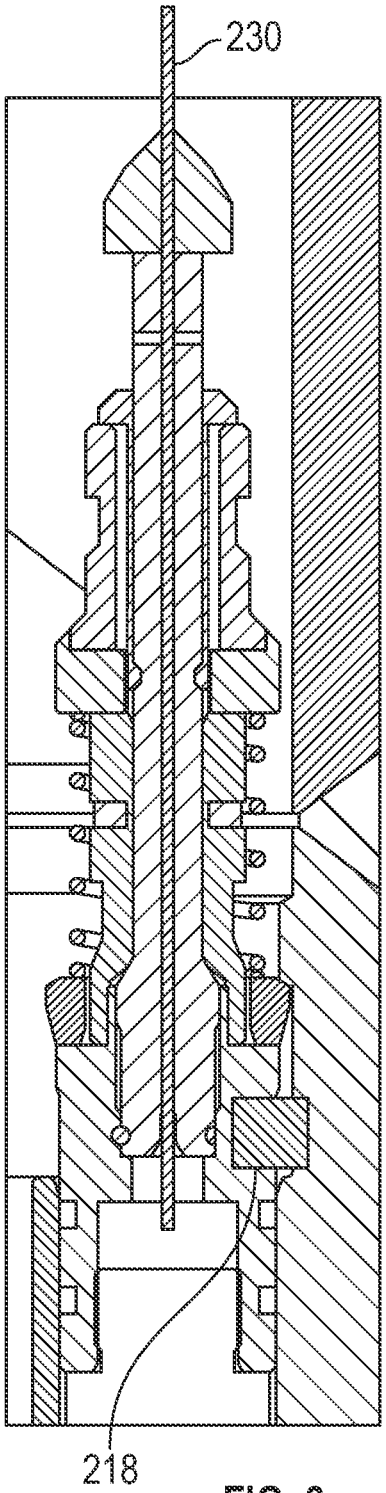
FIG. 8 illustrates a longitudinal cross-section of another example latch according to the present disclosure.
Figure 9:
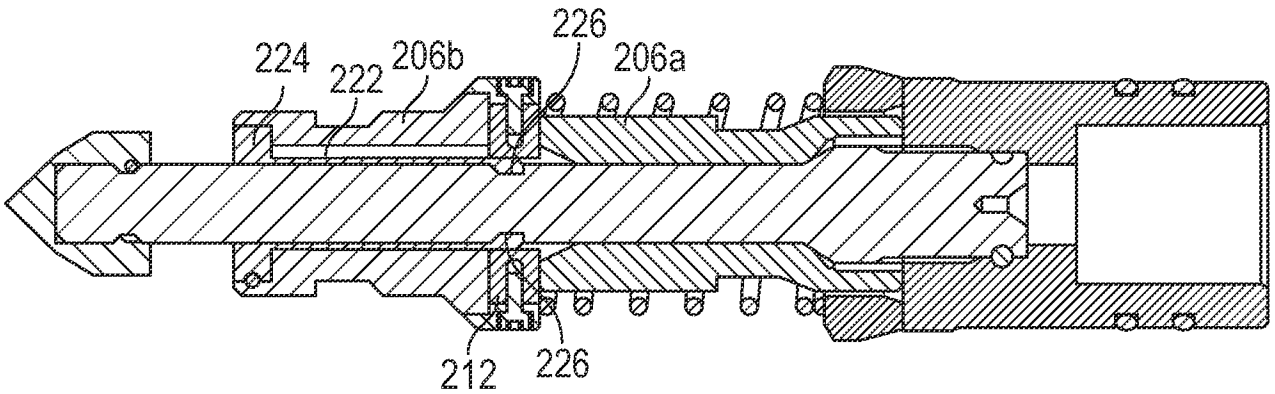
FIG. 9 illustrates a longitudinal cross-section of another example latch according to the present disclosure.

FIG. 8 illustrates another configuration of a latch according to the present disclosure that can share or include some or all of the features shown in and described with respect to FIGS. 5-6B. The configuration of FIG. 8 includes one or more locking dogs 218 similar to the configuration of FIG. 7. However, in the configuration of FIG. 8, when in the expanded or deployed position, the locking dogs 218 engage the mandrel 170 to secure or lock the latch to or relative to the mandrel. Various mechanisms can be used to deploy the locking dogs 218 and/or secure the locking dogs 218 to the mandrel 170, for example, teeth on the locking dogs 218, energized elastomeric components, energized polymer components, and/or chemical reaction(s) to create an expanding material.

Figure 10:
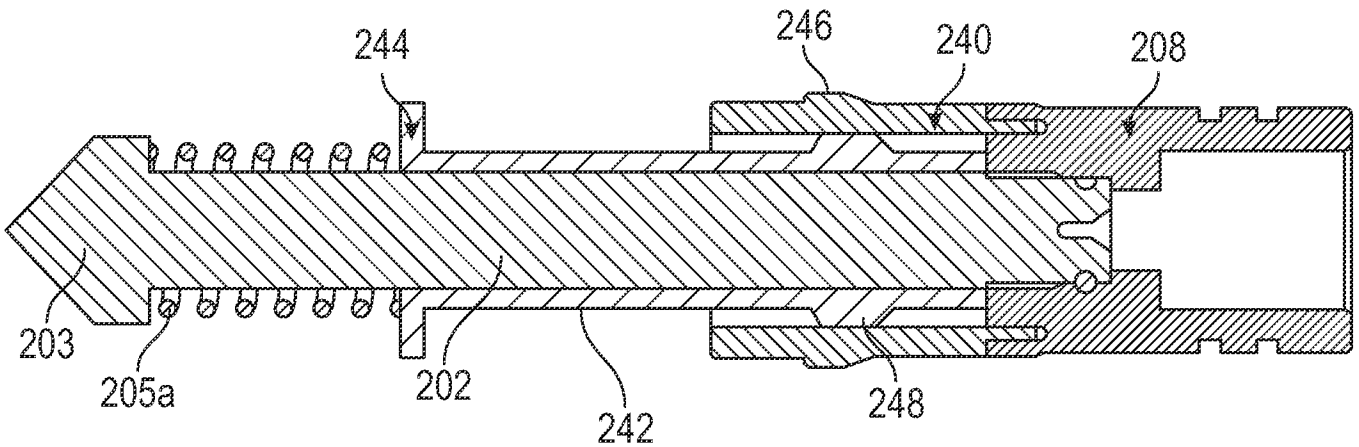
FIG. 10 illustrates a longitudinal cross-section of another example latch according to the present disclosure.

FIG. 10 illustrates another example latch that advantageously reduces the clearance gap between the latch 200 and the mandrel lug 172. The configuration of FIG. 10 includes a collapsible collet 240 and a sliding support sleeve 242 instead of a latch ring 210. As shown, the supporting sleeve 242 is disposed about (e.g., circumferentially about) the running head 202, such that the running head 202 runs through (e.g., longitudinally or axially through) and within (e.g., radially within) the supporting sleeve 242. An upper end or portion of the supporting sleeve 242 includes an outwardly projecting flange 244. An upper end or portion of the running head 202 can include an end cap 203, which may be integrally formed with or coupled to the remainder of the running head 202. A lower end or portion of the running head 202 can extend into and/or be coupled to the latch stop 208. The collet 240 is disposed about (e.g., circumferentially about) a portion of the supporting sleeve 242. A lower end or portion of the collet 240 can be coupled to and/or be disposed adjacent the latch stop 208. A spring 205*a* is disposed about the running head 202 between the end cap 203 and the flange 244 of the supporting sleeve 242.

The collapsible collet 240 is cylindrical and includes axial slots about its circumference. The collet 240 includes one or more tabs 246 protruding outwardly from an outer surface of the collet 240. The supporting sleeve 242 also includes one or more tabs 248 protruding outwardly from an outer surface of the sleeve 242. The supporting sleeve 242 is axially or longitudinally movable relative to the running head 202 and the collet 240.

Figure 11:
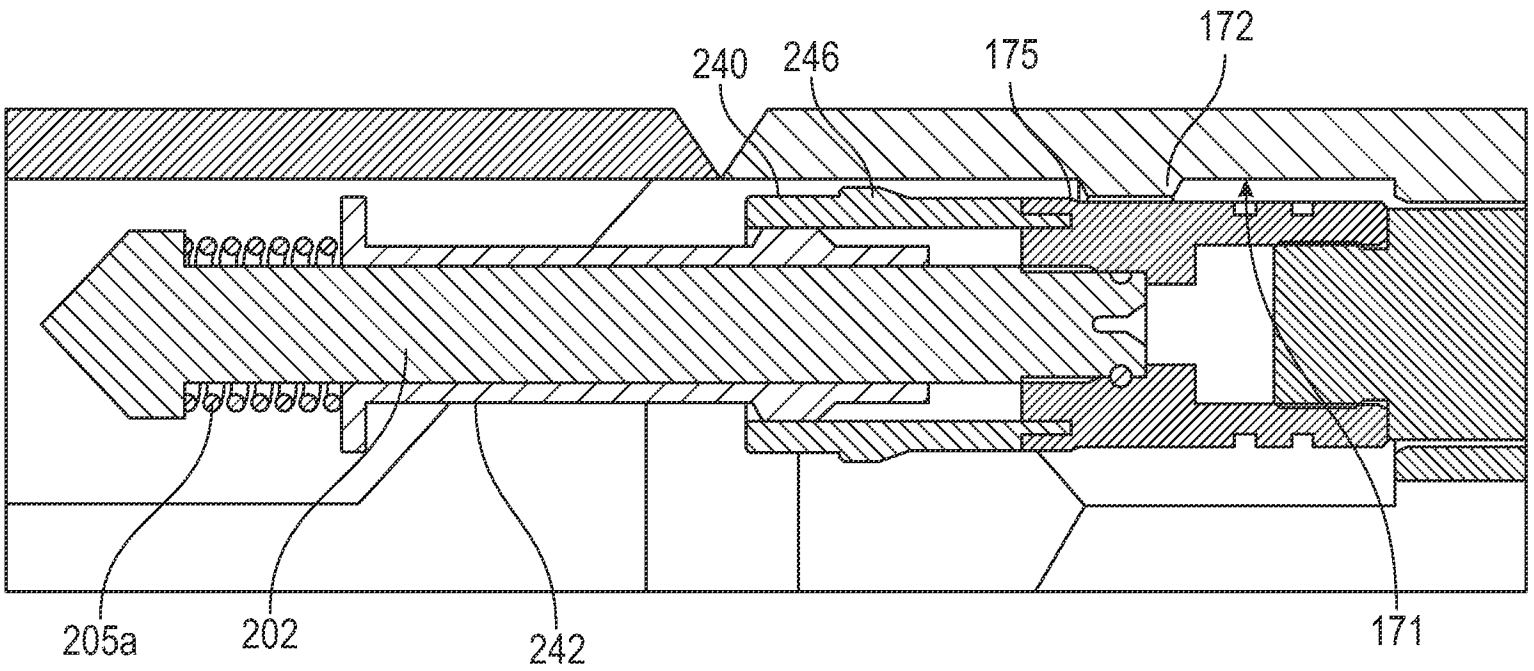
FIGS. 11-13 show stages of installation of the latch of FIG. 10.
Figure 12:
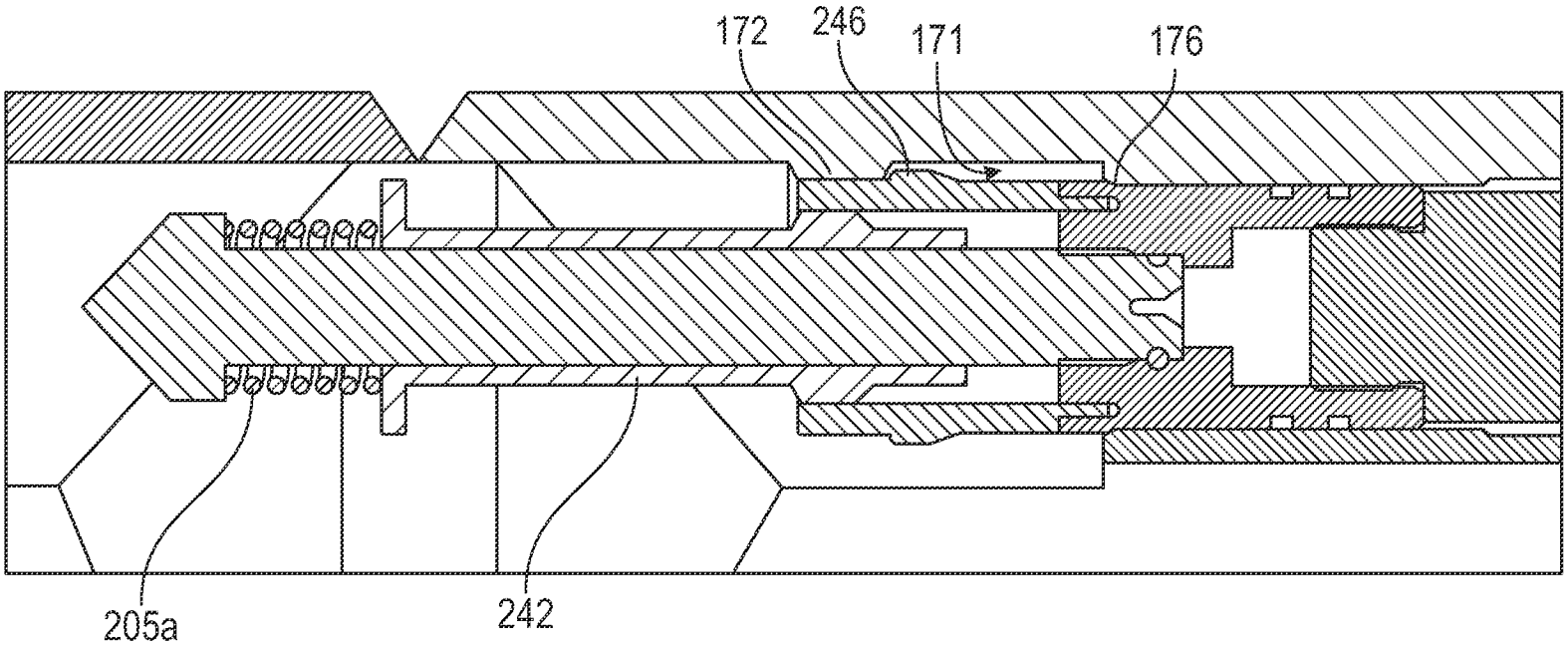

FIG. 11 shows the latch during the initial stages of installation in use. The supporting sleeve 242 is moved upward (toward the left of FIG. 11) relative to the running head 202 and collet 240 and held in place by the running tool (not shown), thereby compressing the spring 205*a* as shown. The tabs 248 are not radially aligned with or supporting the tabs 246 of the collet 240. As the running tool pushes the latch toward the mandrel pocket 171, the tab(s) 246 of the collet contact the mandrel lug 172. The lug 172 exerts a force on the collet 240, causing the collet 240 to collapse radially inward. The axial slots in the collet 240 allow the collet to collapse inward so that the collet tab(s) 246 can pass below the lug 172. When the collet tab(s) 246 have cleared and passed below the lug 172, the collet 240 biases radially outward to its original or default size and/or shape, as shown in FIG. 12. In this position, a no-go down shoulder or chamfer 175 of the latch stop is in contact with or stopped from further movement by the bottom edge of the pocket 171 (the no go down shoulder 176 of the mandrel).

Figure 13:
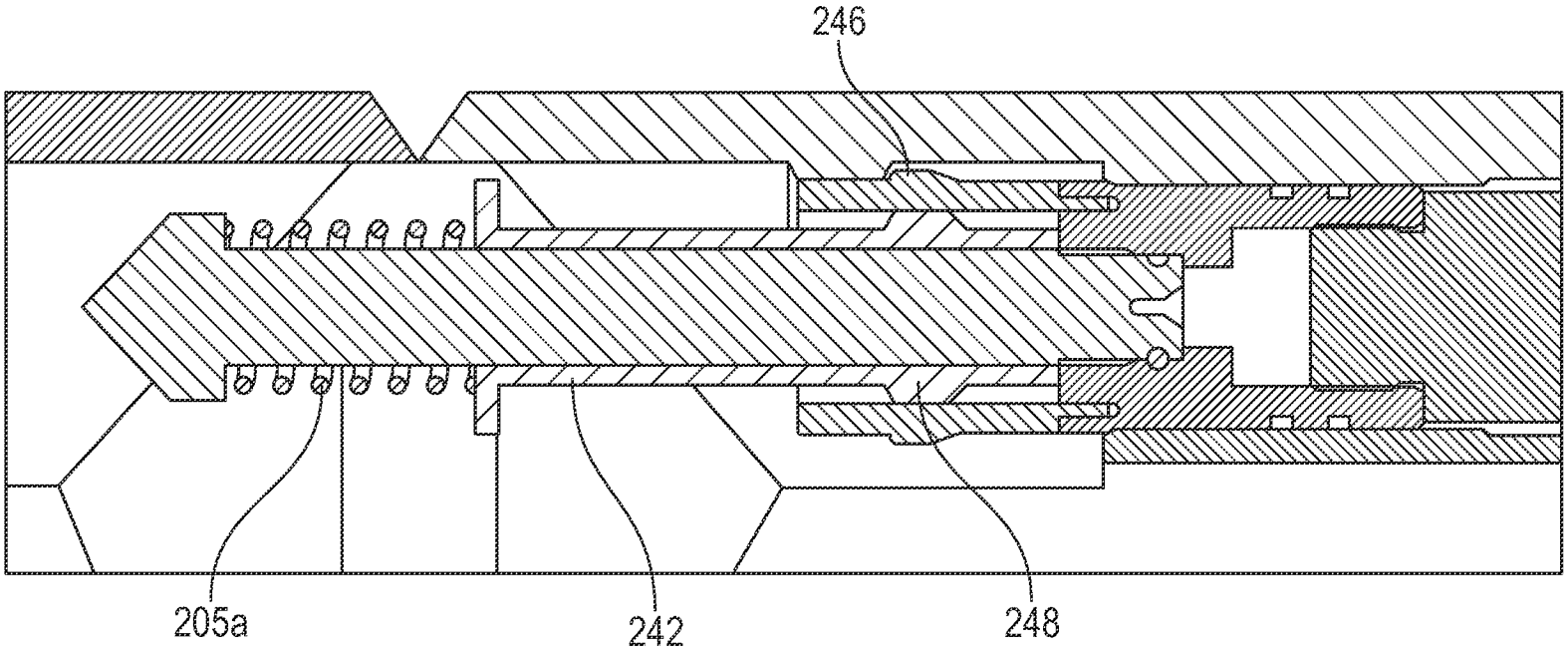

When the running tool is disengaged from the latch, the spring 205*a* expands, pushing the support sleeve 242 downward (toward the right of FIG. 12) as shown in FIG. 13. In this position, the tab(s) 248 of the supporting sleeve provide radial support for the collet 240, preventing or inhibiting the collet 240 from collapsing inwards. As shown, the tab(s) 248 of the support sleeve 242 can be aligned with the tab(s) 246 of the collet 240. The radial support of the support sleeve tab(s) 248 prevents or inhibits the latch from becoming unlatched or free from the lug during well operation. The latch can be sized such that when the no-go down shoulder 175 of the latch contacts the no go down shoulder 176 of the mandrel, an upper surface of the tab(s) 246 of the collet 240 contacts the no go up shoulder 174 of the mandrel, thereby securing the latch in the mandrel pocket and preventing or minimizing axial movement of the latch.

To unlatch and retrieve the latch after well operation, a pulling tool is lowered onto the latch to catch onto the support sleeve 242. The support sleeve 242 is pulled upward or to the left as shown in FIG. 12, compressing the spring 205*a*. When the support sleeve 242 is pulled up, the tabs 248 of the support sleeve 242 move upward. The collet 240 therefore loses its radial support and collapses radially inward as the latch is pulled up. As the pulling tool continues to pull the latch upward, the collapsed collet 240 can pass above the mandrel lug 172. Once clear of the lug 172, the collet 240 can expand back radially outward, as shown in FIG. 11. The latch can then be pulled to the surface with the kickover tool and pulling tool, completing the retrieval process.

FIGS. 14-24 illustrate additional example latch designs that lock in place in the mandrel pocket 171, for example automatically lock on or relative to both the no-go up 174 and no-go down 176 shoulders of the mandrel 170, when set.

Figure 14:
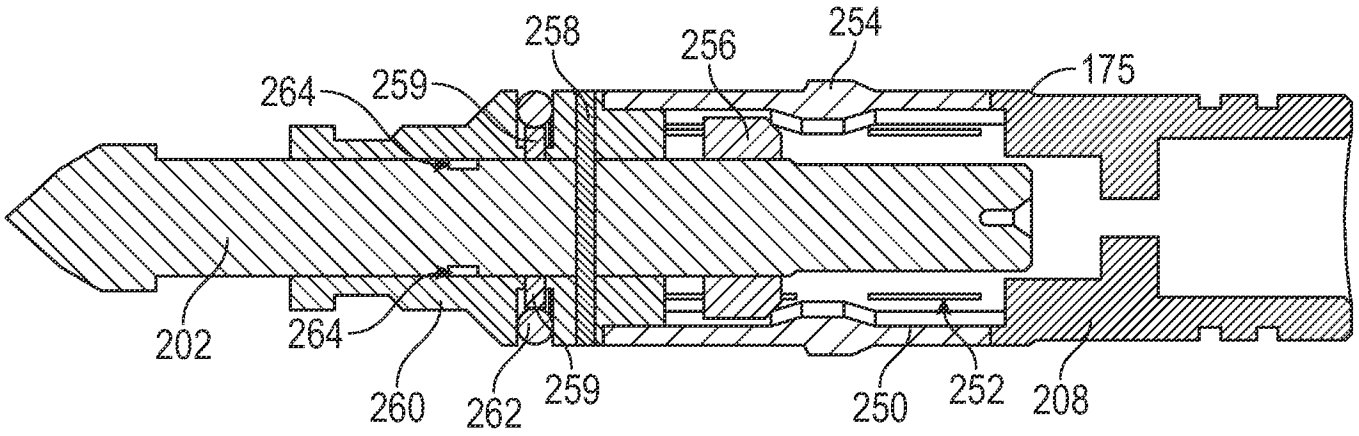
FIG. 14 illustrates a longitudinal cross-section of another example latch according to the present disclosure.

FIG. 14 illustrates an example latch 200 including a latch stop 208, a collet 250 including axial slots 252 and one or more tabs 254, a running head 202 extending through the collet 250, a lock nut 256 disposed radially between the running head 202 and the collet 250, and a shear pin 258 extending transversely through the running head 202. The collet 250 can be integrally formed with, coupled to, or disposed adjacent the latch stop 208. The lock nut 256 is secured to the running head 202 such that the lock nut 256 moves with the running head 202 relative to the collet 250 and latch stop 208 in use. The latch can also include one or more short shear pins 259 disposed in an upper body 260 of the latch. The illustrated configuration includes two short shear pins 259 positioned above the shear pin 258. The short shear pins 259 can be biased (e.g., by one or more biasing elements 262, such as one or more springs, o-rings, or other suitable members) radially inward toward and/or in contact with an outer surface of the running head 202. The running head 202 can include one or more grooves 264 in the outer surface of the running head 202. In the illustrated configuration, the grooves 264 are positioned above the shear pin 258.

Figure 15:
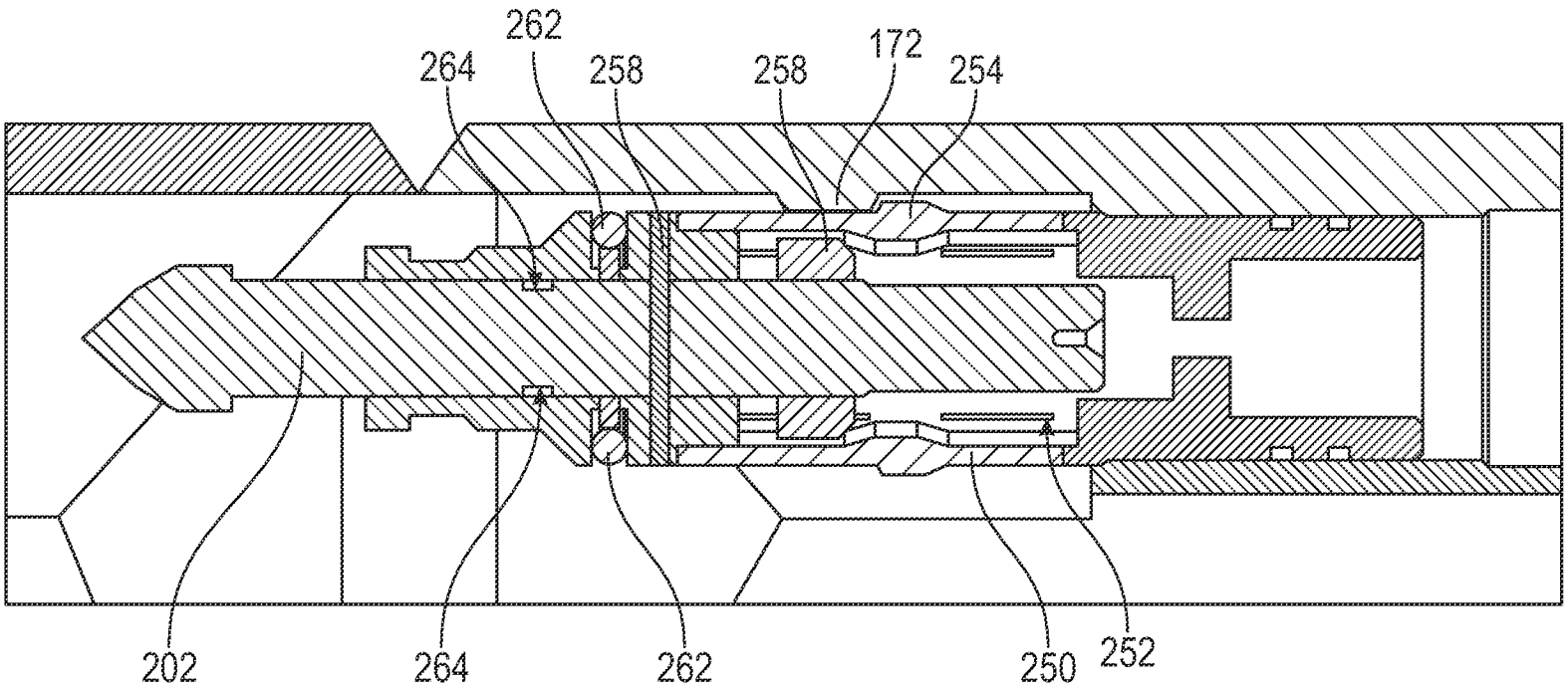
FIG. 15 illustrates the latch of FIG. 14 during installation.

During deployment, the latch is moved into the mandrel pocket 171 until the shoulder 175 of the latch stop 208 contacts the no go down shoulder 176 of the mandrel, as shown in FIG. 15. Similar to the latch of FIGS. 10-13, as the running tool pushes the latch toward the mandrel pocket 171, the tab(s) 254 of the collet 250 contact the mandrel lug 172. The lug 172 exerts a force on the collet 250, causing the collet 250 to collapse radially inward. The axial slots 252 in the collet 250 allow the collet 250 to collapse inward so that the collet tab(s) 254 can pass below the lug 172. When the collet tab(s) 254 have cleared and passed below the lug 172, the collet 250 biases radially outward to its original or default size and/or shape, as shown in FIG. 15. The latch of FIG. 14 can be sized such that when the no-go down shoulder 175 of the latch contacts the no go down shoulder 176 of the mandrel, an upper surface of the tab(s) 254 of the collet contacts the no down up shoulder 174 of the mandrel.

Figure 16:
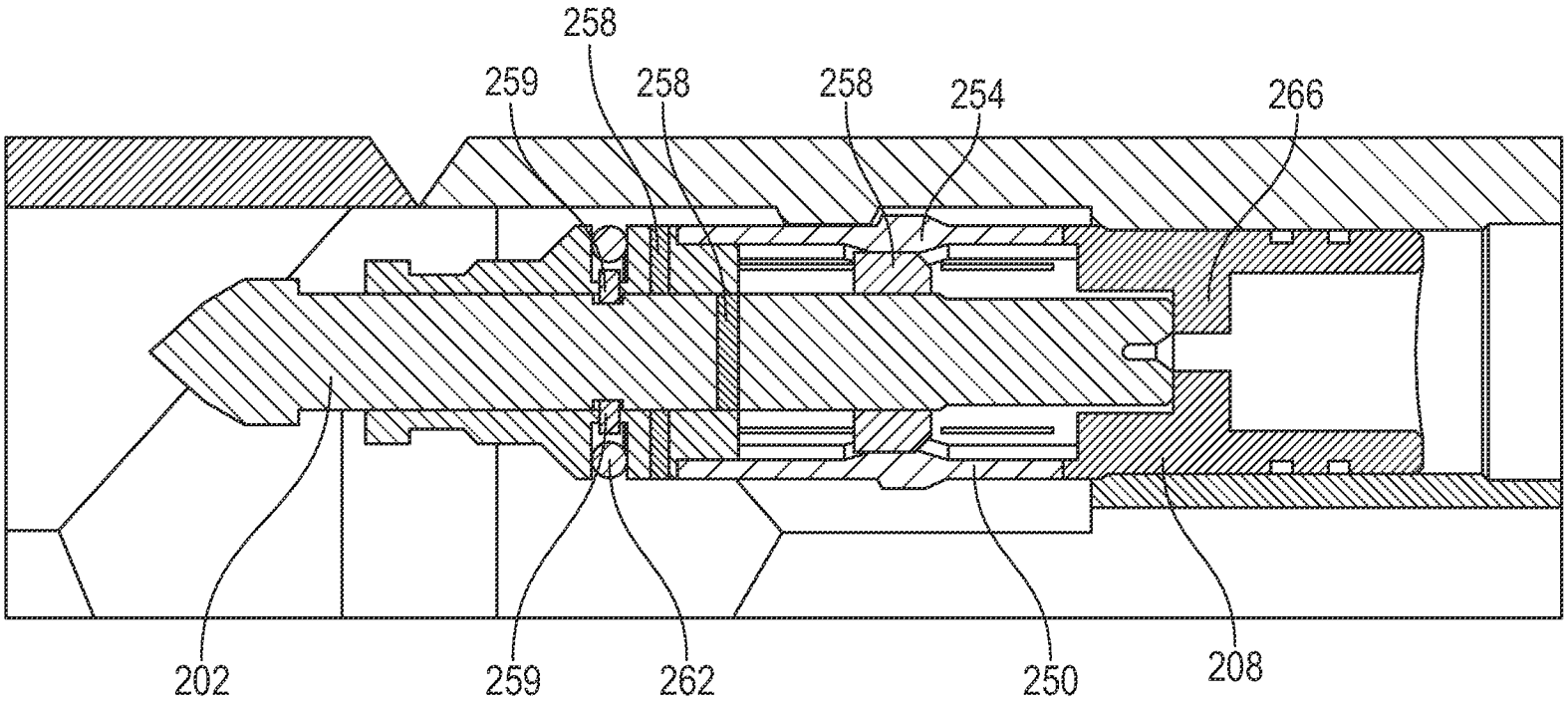
FIG. 16 illustrates the latch of FIG. 14 in the set position.

The running tool is then used to perform a jar down action. As shown in FIG. 16, the jar down action causes: (1) the shear pin 258 to shear; (2) which allows the running head 202 to be pushed down (toward the right in the orientation of FIG. 15) until the running head 202 shoulders on an inner shoulder 266 of the latch stop 208, thereby stopping further movement; (3) the lock nut 258 to move downward (toward the right) with the running head 202 until the lock nut 258 is aligned with the tab 254 of the collet 250; and (4) the grooves 264 to move into alignment with the short shear pins 259 such that the short shear pins 259 can be biased or pushed into the grooves 264 by the springs 262. In this position, the lock nut 258 provides radial support for the collet 250, preventing or inhibiting the collet 250 from collapsing inwards. The latch is then in its set position, locked in the mandrel pocket 171. The engagement of the short shear pin(s) 259 with the groove(s) 264 can help lock the axial position of the running head 202, and therefore help lock the axial position of the lock nut 258 relative to (aligned with) with the tab(s) 254 of the collet 250.

To remove the latch, a pulling tool is run in hole to catch a pulling fish neck on the latch. A jar up operation is performed to shear the small shear pins 259, which allows the running head 202 to be pulled upward, thereby moving the lock nut 258 out of alignment with the tab(s) 254 of the collet 250. The collet 250 can then collapse inward to allow the latch to be removed.

Figure 17:
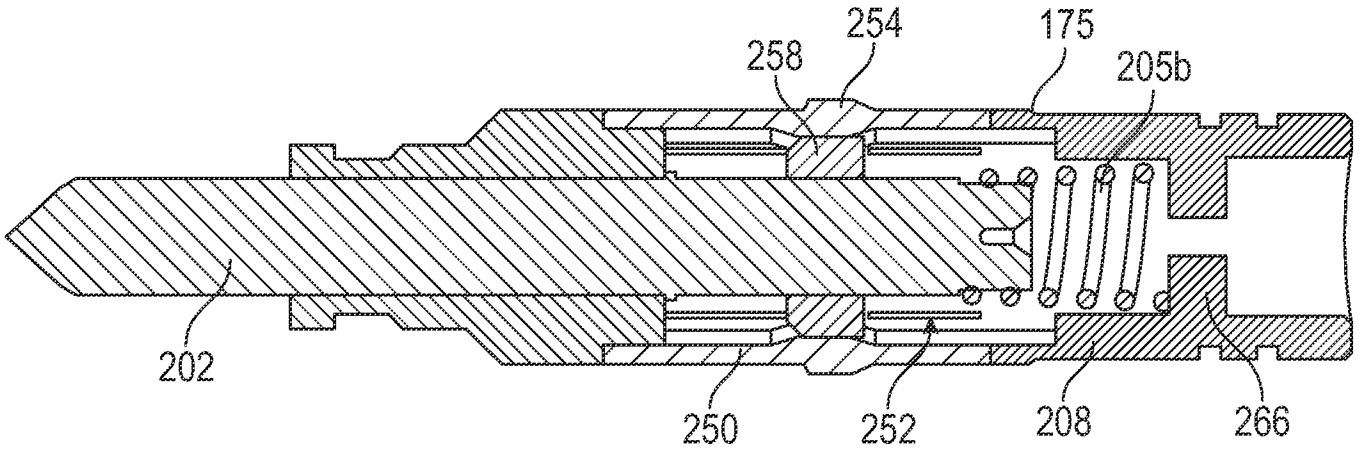
FIG. 17 illustrates a longitudinal cross-section of another example latch according to the present disclosure.

FIG. 17 illustrates an example latch including a latch stop 208, a collet 250 including axial slots 252 and one or more tabs 254, a running head 202 extending through the collet 250, a lock nut 258 disposed radially between the running head 202 and the collet 250, and a spring 205*b* coupled to a lower end of the running head 202 and disposed axially between the running head 202 and an inner shoulder 266 of the latch stop 208. The collet 250 can be integrally formed with, coupled to, or disposed adjacent the latch stop 208. The lock nut 258 is secured to the running head 202 such that the lock nut 258 moves with the running head 202 relative to the collet 250 and latch stop 208 in use.

Figure 18:
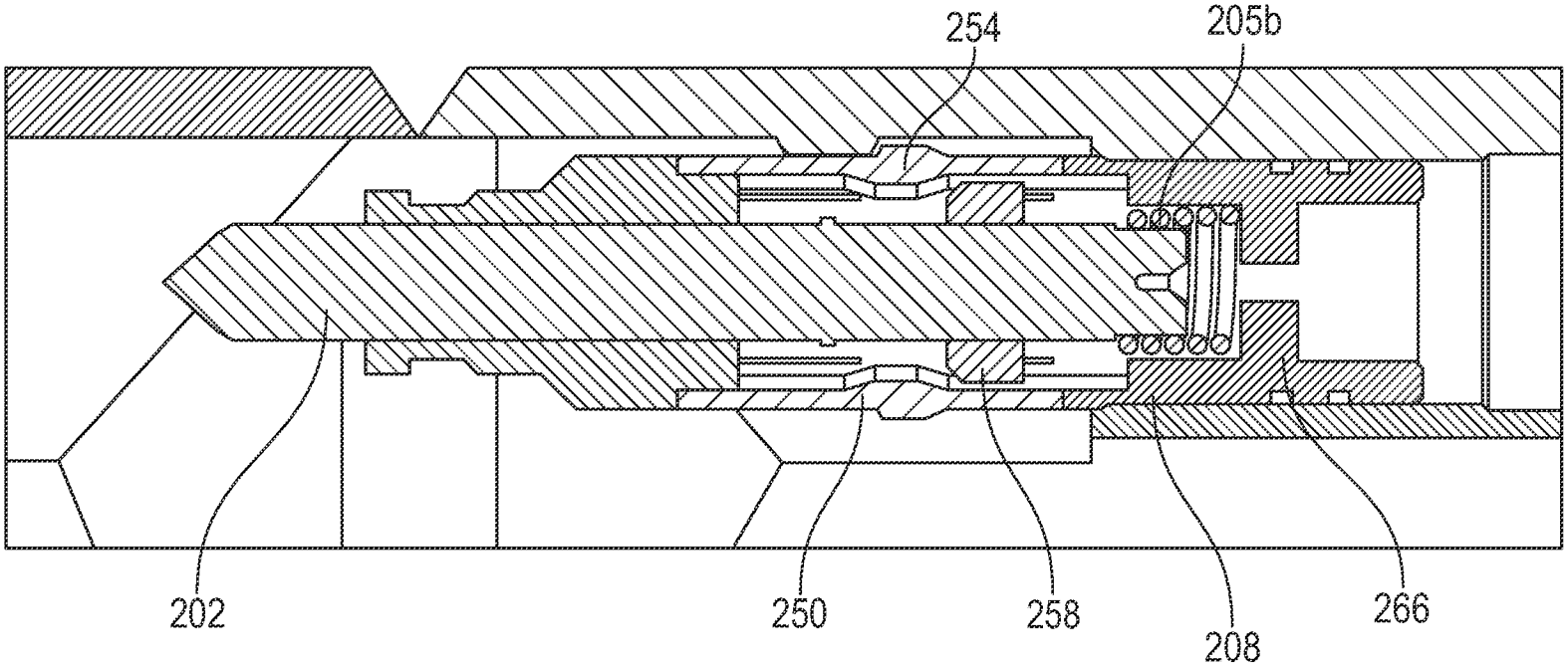
FIG. 18 illustrates the latch of FIG. 17 during installation.

For deployment, the running head 202 is moved downward (toward the right in the figures) relative to the collet 250 and latch stop 208, thereby compressing the spring 205*b*, as shown in FIG. 18. The latch is moved into the mandrel pocket 171 until the shoulder 175 of the latch stop 208 contacts the no go down shoulder 176 of the mandrel, as also shown in FIG. 18. Similar to the latch of FIGS. 10-13, as the running tool pushes the latch toward the mandrel pocket, the tab(s) 254 of the collet contact the mandrel lug 172. The lug 172 exerts a force on the collet 250, causing the collet 250 to collapse radially inward. Axial slots 252 in the collet allow the collet to collapse inward so that the collet tab(s) 254 can pass below the lug. When the collet tab(s) 254 have cleared and passed below the lug 172, the collet 250 biases radially outward to its original or default size and/or shape, as shown in FIG. 18. The latch of FIG. 17 can be sized such that when the no-go down shoulder 175 of the latch contacts the no go down shoulder 176 of the mandrel, an upper surface of the tab(s) 254 of the collet contacts the no down up shoulder 174 of the mandrel.

Figure 19:
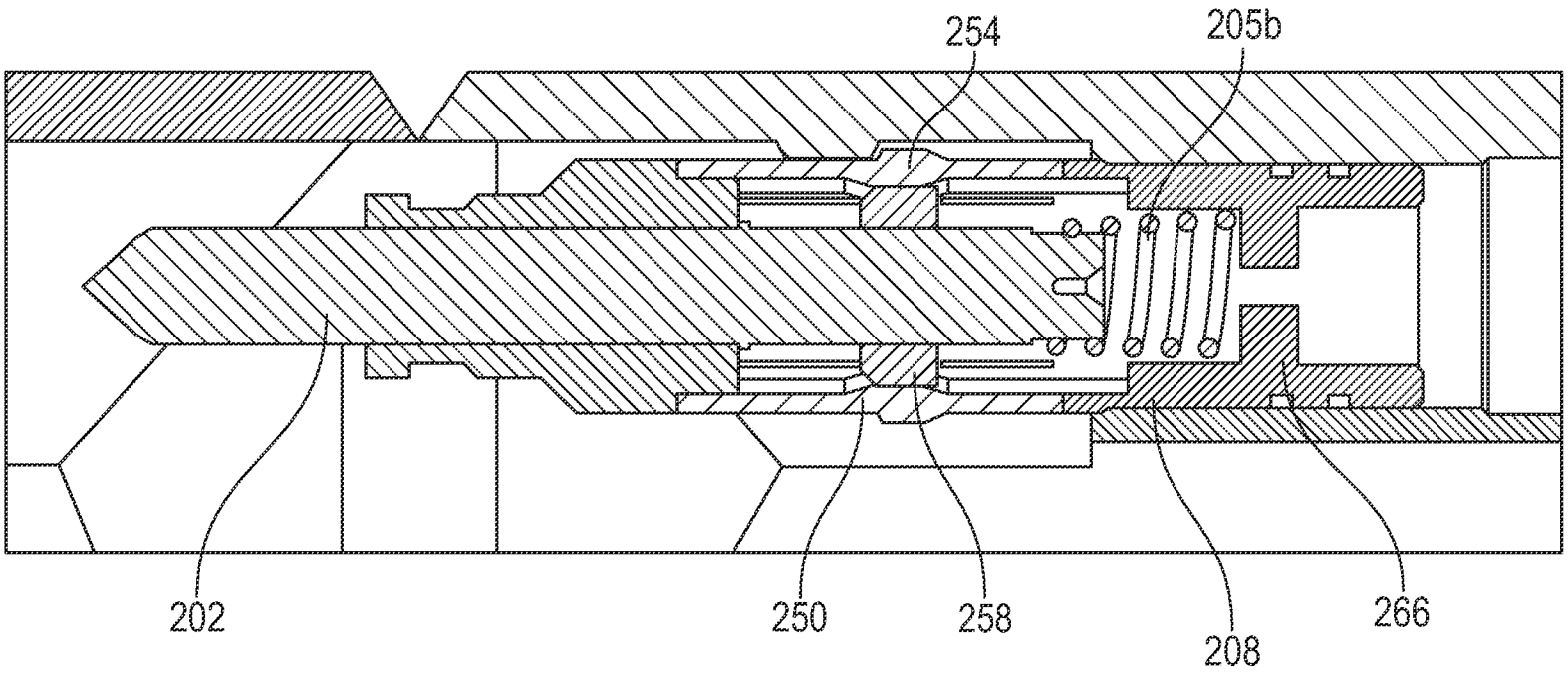
FIG. 19 illustrates the latch of FIG. 17 in the set position.

The running tool is then used to perform a jar down action. The jar down action causes the running tool to be released from the latch (e.g., a fishneck of the latch). When the running tool is disengaged from the latch, the spring 205*b* expands, pushing the running head 202 upward (toward the left of the figures) as shown in FIG. 19. Movement of the running head 202 moves the lock nut 258 into alignment with the tab(s) 254 of the collet 250. In this position, the lock nut 258 provides radial support for the collet 250, preventing or inhibiting the collet from collapsing inwards. The latch is then in its set position, locked in the mandrel pocket.

To remove the latch, a pulling tool is run in hole to catch the pulling fish neck on the latch. The running head 202 is pushed downward (to the right), compressing the spring 205*b* and moving the lock nut 258 out of alignment with the tab(s) 254 of the collet. The collet 250 can then collapse inward and allow the latch to be pulled upward out of the pocket.

Figure 20:
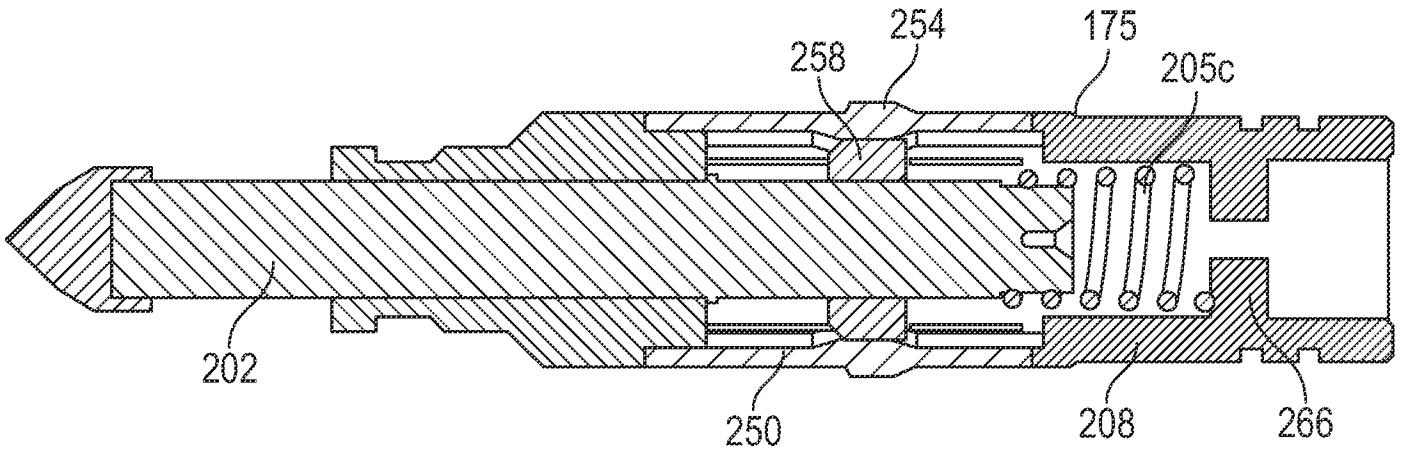
FIG. 20 illustrates a longitudinal cross-section of another example latch according to the present disclosure.
Figure 21:
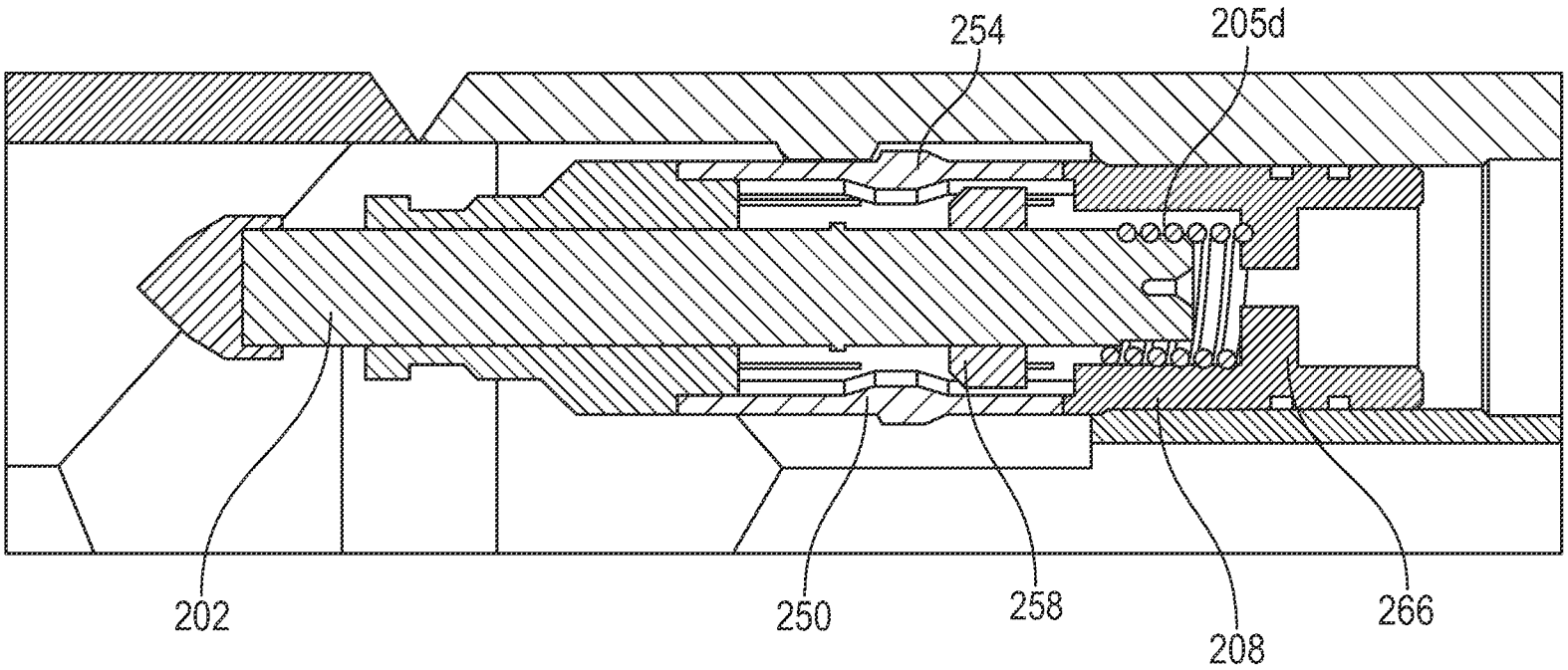
FIG. 21 illustrates the latch of FIG. 20 during installation.
Figure 22:
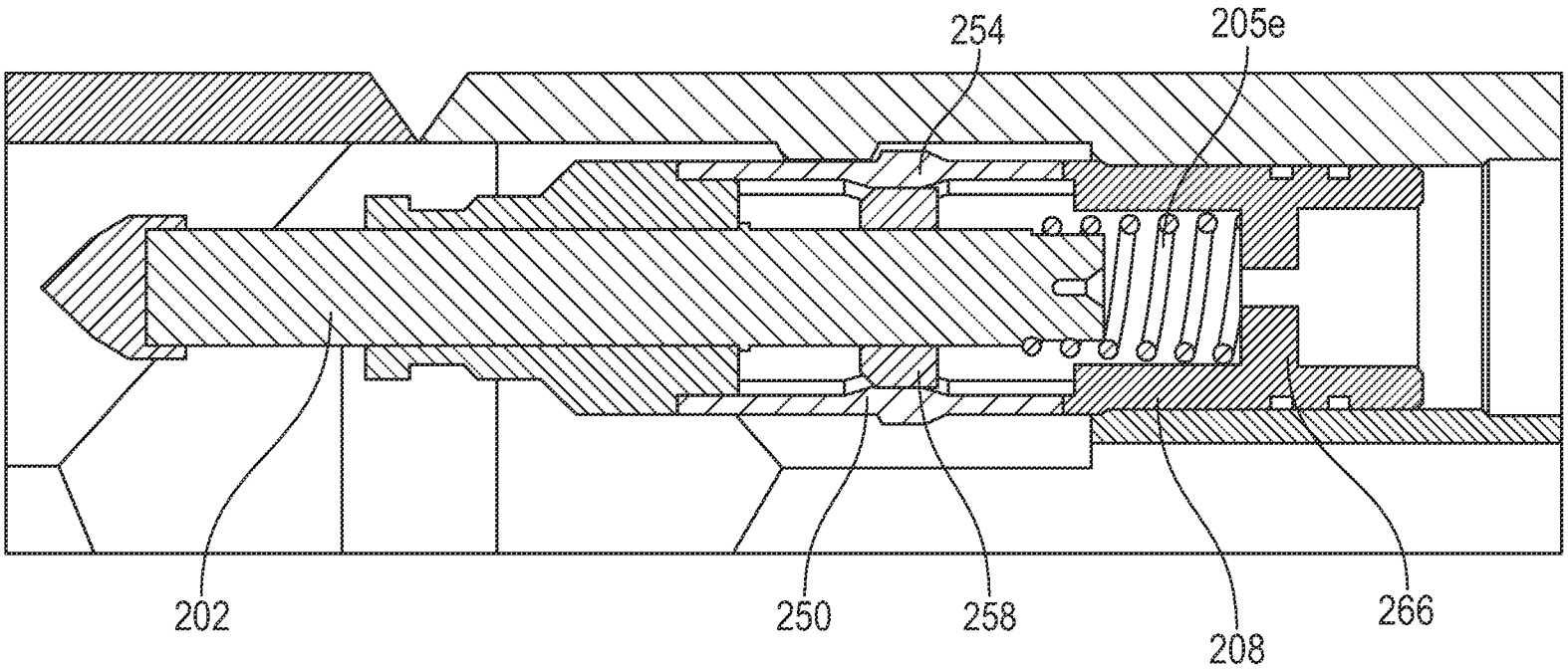
FIG. 22 illustrates the latch of FIG. 20 in the set position.

FIGS. 20-22 illustrate a latch that is substantially the same and operates substantially the same as the latch of FIGS. 17-19. However, during installation of the latch of FIG. 20, the jar up action by the running tool causes the running tool to lift the running head 202 and lock nut 258 into the locking position in which the lock nut 258 is aligned with the tab(s) 254 of the collet 250. A further jar up action can shear a shear pin of the running tool, which allows the running tool to release from the latch (e.g., a fish neck of the latch). The spring 205*c* can then hold the lock nut 258 in the locking position. The latch of FIGS. 20-22 can advantageously provide feedback to the operator that the latch was installed properly.

Figure 23:
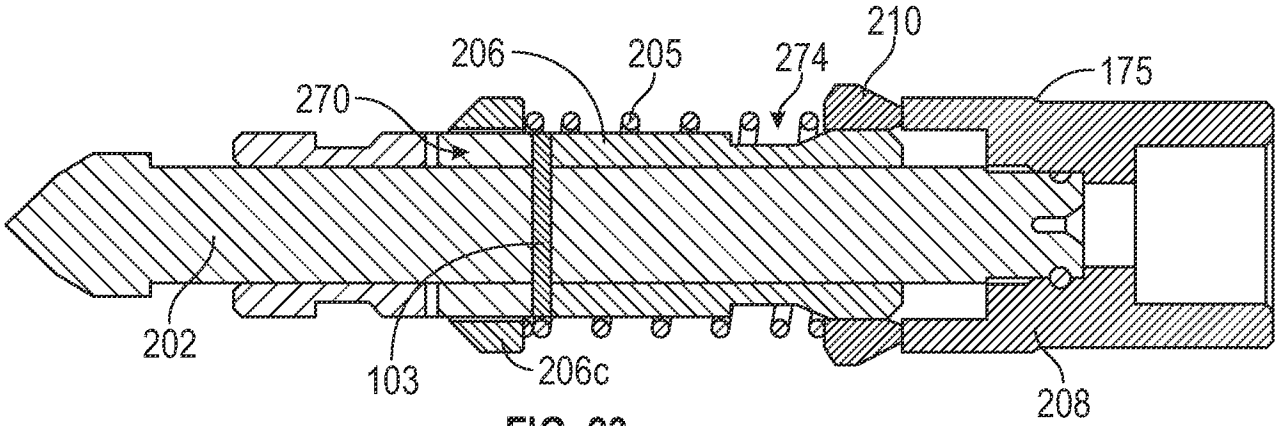
FIG. 23 illustrates a longitudinal cross-section of another example latch according to the present disclosure.
Figure 24:
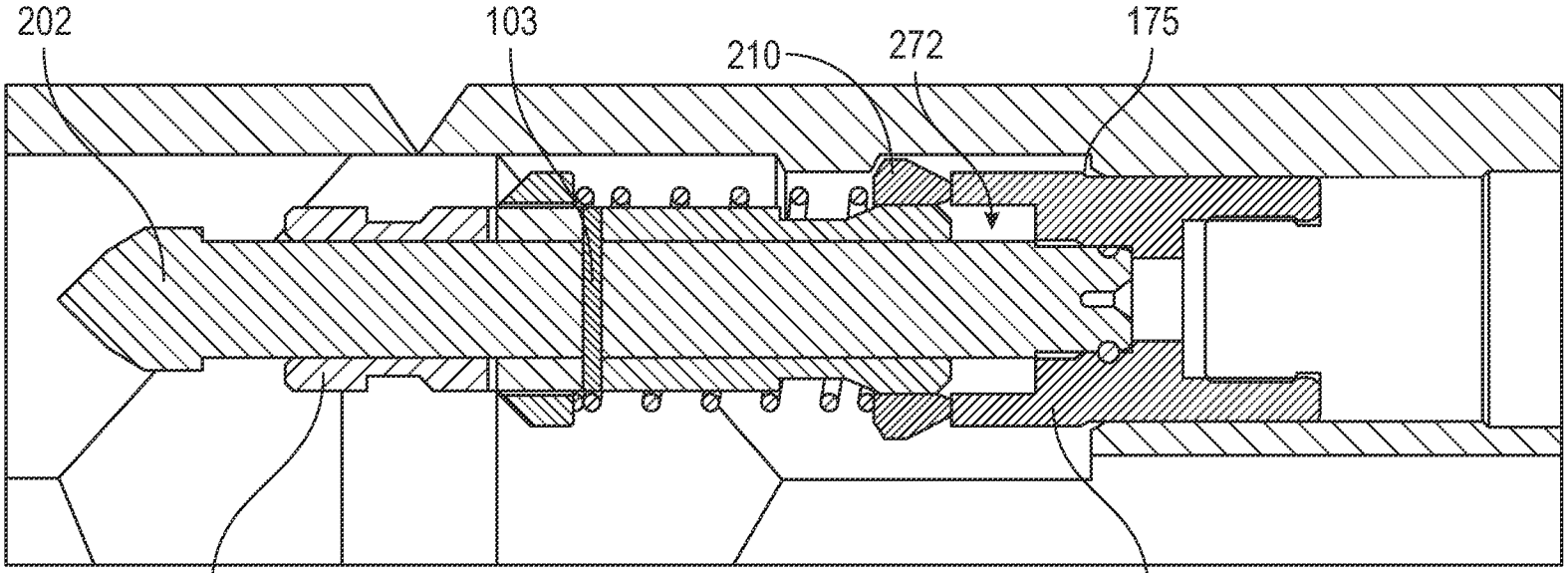
FIG. 24 illustrates the latch of FIG. 23 set in a mandrel.

FIGS. 23-24 illustrate another example latch that advantageously reduces the clearance gap between the latch 200 and the mandrel lug 172 and/or automatically locks the latch 200 and gas lift valve 150 in location to minimize movement of the valve 150 due to annulus and tubing pressure changes. The illustrated latch 200 is similar to the latch of FIGS. 3A-3B. However, compared to the latch of FIGS. 3A-3B, the latch 200 of FIGS. 23-24 has a longer dimension from the top of the latch stop 208 to the no go down shoulder 175 of the latch stop 208, which reduces the range of movement of the latch within the mandrel pocket 171. As shown, the latch 200 includes a latch stop 208, a running head 202 integrally formed with or coupled to, and extending upward from, the latch stop 208, a latch body 206 disposed circumferentially about at least a portion of the running head 202, and a latch ring 210 disposed circumferentially about the latch body 206. A spring 205 is disposed circumferentially about the latch body and extends axially from a top of the latch ring 210 to a lower surface of a latch stopper 206*c* of or coupled to the latch body 206.

A shear pin 103 extends through (e.g., radially or transverse through) the running head 202. Whereas in the latch of FIGS. 3A-3B the latch body 206 has a radially or transversely extending hole to accommodate the shear pin 103, the latch body 206 of the latch of FIGS. 23-24 includes one or more longitudinal slots 270 extending along a portion of the length of the latch body 206. In the illustrated configuration, the slot 270 includes two slots 270 disposed 180° from each other, each slot 270 accommodating one end of the shear pin 103. The shear pin 103 slides along or relative to the slot 270, such that the slot 270 allows the latch body 206 to slide axially along the running head 202 during installation. The latch stopper 206*c* can help keep the shear pin 103 in place and prevent the shear pin 103 from sliding out through the slots 270. In some configurations, the shear pin 103 is made of INC625.

The latch of FIGS. 23-24 also includes an undercut 272 recessed into the top of the latch stop 208. The undercut 272 can be machined into the top of the latch stop 208, for example as shown in FIG. 23. In other configurations, depending on the configuration of the running head 202 and latch stop 208, the undercut 272 could be defined by inner diameter surface(s) of the latch stop 208 and/or outer diameter surface of the running head 202 (for example as shown in and described with respect to FIG. 26). The undercut 272 allows the latch body 206 to slide axially, to the right in the orientation of the figures, into the undercut 272. When a bottom portion of the latch body 206 slides into the undercut 272, a cutout or recess 274 in the outer surface of the latch body 206 slides into alignment (e.g., radial alignment) with the latch ring 210 such that the latch ring 210 can collapse into the cutout 274.

The longitudinal slot 270 for the shear pin 103 and the undercut 272 in the latch stop 208 advantageously allow the latch ring 210 to pass under the mandrel lug 172 during installation without requiring a large clearance between the latch 200 and mandrel 170. In a traditional latch 100, as shown in FIG. 3A-3B, when the latch ring 110 contacts the top of the mandrel lug 172 during installation, the latch ring 110 moves up into a cutout 274 in the outer surface of the latch body 106, compressing the spring 105. Once clear of the mandrel lug 172, the spring 105 biases the latch ring 110 back downward and into the locked position. As the latch ring 110 is displaced upwardly during installation, a larger clearance is needed in the pocket 171 for the latch ring 110 to clear the mandrel lug 172. In other words, the distance from the no go down shoulder 175 of the latch stop 108 to the top of the latch ring 110 when displaced upwardly into the cutout 274 must be about the same and/or slightly smaller than the length of the mandrel pocket 171. When the latch ring 110 is biased back to its locking position in the mandrel after clearing the mandrel lug 172, the distance from the no go down shoulder 175 of the latch stop 108 to the top of latch ring 110 reduces, creating a large range of movement d1 of the latch in the pocket 171.

In the latch of FIGS. 23-24, the latch body 206 is able to displace relative to the running head 202 and into the undercut 272 during installation, and the cutout 274 moves to the latch ring 210. The latch ring 210 can therefore remain axially in place, and the distance from the no go down shoulder 175 of the latch stop 208 to the top of the latch ring 210 remains the same as the latch ring 210 is clearing the mandrel lug 172 and when the latch ring 210 is in the mandrel pocket 171. As the latch ring 210 is not displaced axially (relative to the latch stop 208) during installation, a smaller clearance is needed in the pocket 171 for the latch ring 210 to clear the mandrel lug 172. In other words, the distance from the no go down shoulder 175 of the latch stop 208 to the top of the latch ring 210 in its normal position must be about or approximately the same and/or slightly smaller than the length of the mandrel pocket 171. Given the same size pocket 171, the length of the latch stop 208 from the top of the latch stop 208 to the no go down shoulder 175 can therefore be increased. The no go down shoulder 175 of the latch stop 208 can lock against the no go down shoulder 176 of the mandrel pocket 171, and the top of the latch ring 210 can lock against the no go up shoulder 174 on the bottom of the mandrel lug 172 when the latch is installed. As a large required clearance creates a large range of movement of the latch relative to the mandrel, reducing the clearance advantageously reduces the range of movement.

To install the latch of FIGS. 23-24, the latch body 206 is moved into the undercut 272, compressing the spring 205, and the shear pin 103 relatively moves toward the left in the slot 270 (in other words, the shear pin 103 remains fixed to the running head 202, and the latch body 206 and slot 270 move down or to the right relative to the running head 202 and the shear pin 103). Movement of the latch body 206 into the undercut 272 can allow the latch ring 210 to collapse into the cutout 274 in the outer surface of the latch body 206 so that the latch ring 210 can pass below the mandrel lug 172. A running tool pushes the latch into the mandrel pocket 171 until stopped by contact of the no-go down shoulders. The latch ring 210 is then disposed in the mandrel pocket 171. When the latch body 206 is released, the spring 205 biases the latch body 206 out of the undercut 272, the shear pin 103 moves relatively toward the right of the slot 270, and the latch ring 210 is pushed outward by movement of the latch body 206 forcing the latch ring 210 out of the cutout 274. The latch is secured by the latch ring 210 contacting the no go up shoulder 174 of the mandrel 170. In some configurations, pulling up on the running tool shears a shear pin of the running tool, and the running tool is released from the running head.

To remove the latch, a pulling tool is run in hole to catch the fish neck of the latch body 206. In some configurations, to allow the pulling tool to engage the fish neck on the latch body, the latch body 206 moves into the undercut 272 and shoulders on the latch stop 208 to provide a support point. A pull up or jar up action on the latch body can shear the shear pin 103 of the latch and allow the latch body 206 to move up (or toward the left of the figures) relative to the running head 202. The latch body 206 shoulders with the running head 202, leaving the latch ring 210 unsupported and allowing the latch ring 210 to collapse. A continuous pull up action allows the latch ring 210 to move past and clear the mandrel lug 172, and pulls the latch out of the pocket.

Figure 26:
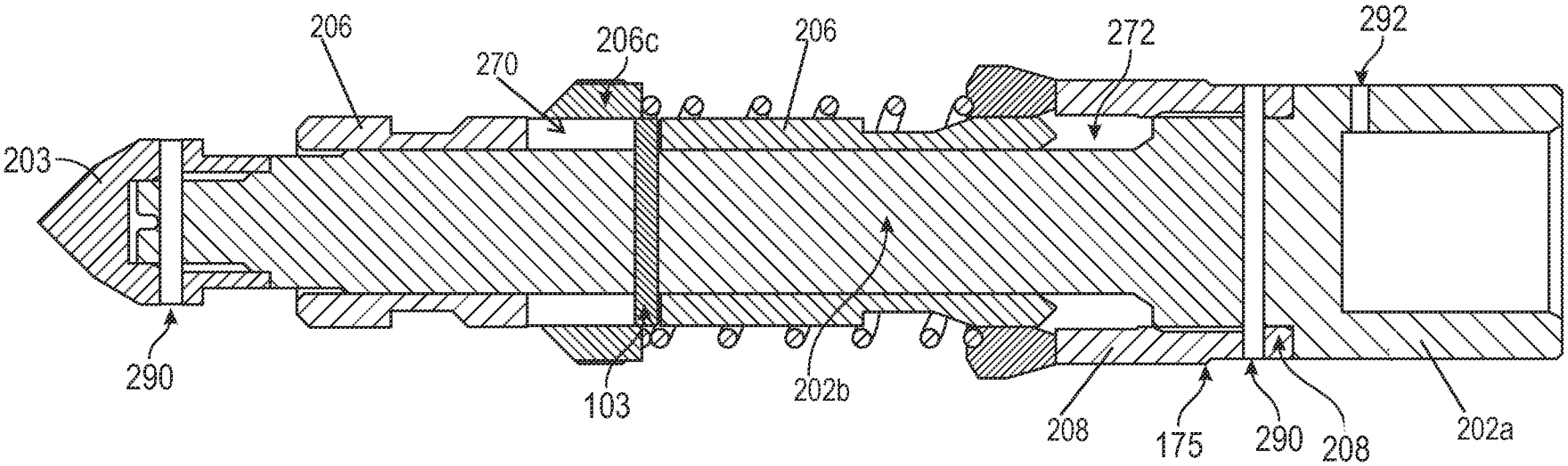
FIG. 26 illustrates a longitudinal cross-section of another example latch according to the present disclosure.
Figure 27:
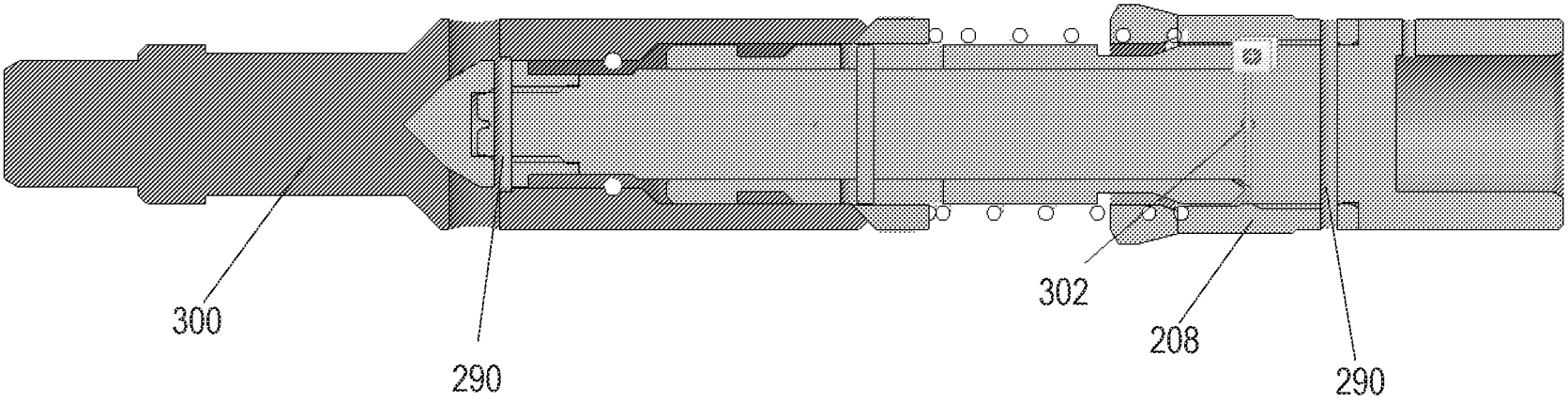
FIG. 27 illustrates the latch of FIG. 26 coupled to a running tool.

FIGS. 26-27 illustrate a variation of the latch of FIGS. 23-24. In this configuration, during installation, as the running tool 300 pushes the latch body 206 into the undercut 272, the latch body 206 does not shoulder or bottom out against a base of the undercut 272 (which may be defined by a surface of the latch stop 208 as shown in FIG. 23 or by a surface of the running head 202 as shown in FIG. 26), and instead maintains a clearance 302, as shown in FIG. 27. In some configurations, the clearance is about 0.050". The downward jarring forces are therefore not transmitted from the running tool 300 to the latch body 206 and latch stop 208. The wall of the latch body 206 can therefore be made thinner without risking the latch body 206 buckling.

The latch stop 208 can be a one-piece component, or multiple pieces coupled together. The running head 202 can be integrally formed with the latch stop 208, or a component thereof, or can be a separate piece coupled to the latch stop 208, for example via one or more roll pins 290. In the illustrated configuration, the running head 202 includes a base portion 202*a* and a post 202*b* extending upward from the base 202*a*. The latch stop 208 can be coupled to the base 202*a* (e.g., via roll pins 290) and disposed circumferentially about a portion of the base 202*a* and running head 202. In the illustrated configuration, the latch stop 208 can be a sleeve disposed about a portion of the running head 202. The undercut 272 can be defined by an inner surface of the latch stop 208, an outer surface of the post 202*b*, and/or an upper surface of the base 202*a*.

One or more roll pins 290 can also be used to secure an end cap 203 to the running head 202. Other coupling mechanisms could be used instead of or in addition to the roll pins 290. For example, a threadlocker compound (such as Loctite) and/or a self-locking thread (such as Spiralock). The latch stop 208 or a base of the running head 202 can include a vent hole 292 to prevent or inhibit pressure from being trapped between the latch and valve. The latch 200 may not include o-rings on the outer diameter of the latch stop 208 or base of the running head 202 to help reduce the "stick-slip" effect, and thereby reduce the impact velocity of the latch if the latch slides up due to pressure reversals.

Figure 25A:
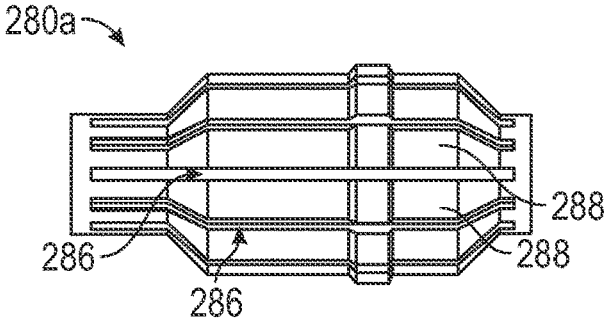
FIGS. 25A-25B illustrate an example collet sleeve for use in an example latch.
Figure 25B:
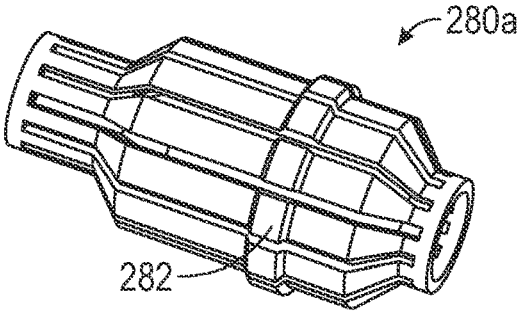
Figure 25C:
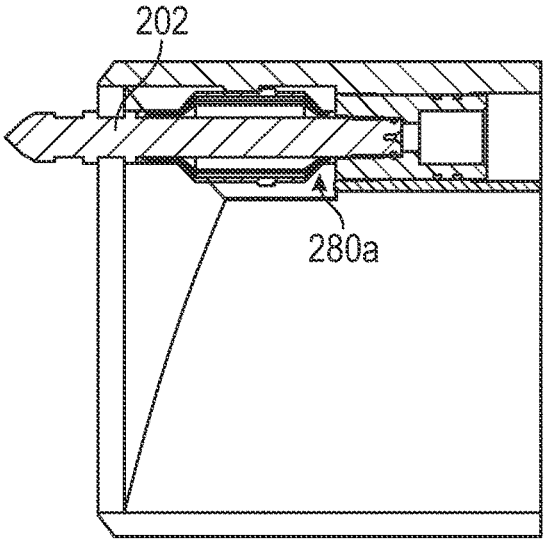
FIG. 25C illustrates a latch including the collet sleeve of FIGS. 25A-25B disposed in a mandrel.
Figure 25D:
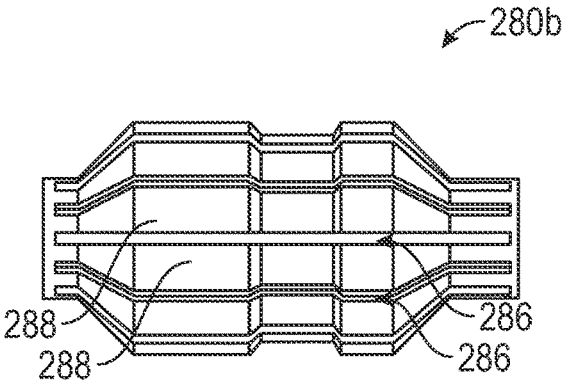
FIGS. 25D-25E illustrate another example collet sleeve for use in an example latch.
Figure 25E:
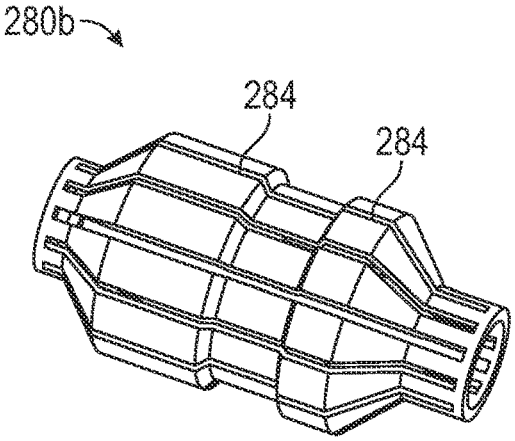
Figure 25F:
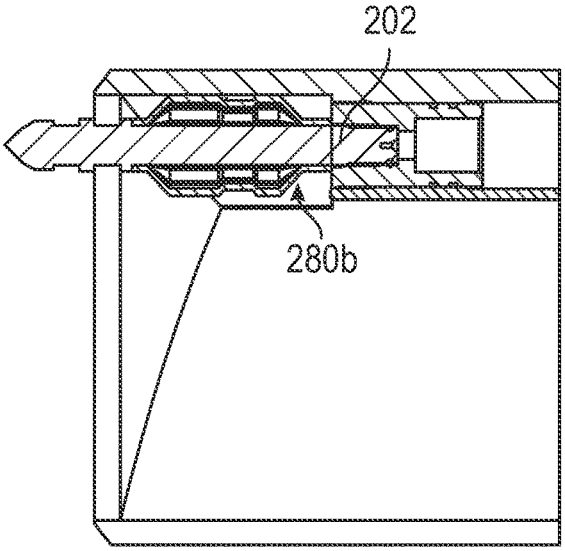
FIG. 25F illustrates a latch including the collet sleeve of FIGS. 25D-25E disposed in a mandrel.

FIGS. 25C and 25F illustrate example latch designs including a collet sleeve 280 instead of a shear pin and latch ring mechanism. FIGS. 25A-25B illustrate the collet 280*a* of the latch of FIG. 25C, and FIGS. 25D-25E illustrate the collet 280*b* of the latch of FIG. 25F. The collet sleeve 280 secures the gas lift valve 150 in the mandrel pocket bore by a collet profile locking into the pocket below the mandrel lug 172. The collet of FIGS. 25A-25C includes a radial projection 282 that engages or contacts the bottom of the mandrel lug 172. The collet of FIGS. 25D-25F includes two projections 284. When installed, one projection 284 contacts the top of the mandrel lug 172 and the other contacts the bottom of the mandrel lug 172, such that the mandrel lug 172 is disposed axially between the two projections 284. The collet sleeve 280 is supported structurally by the running head 202. The collet profile engages or contacts the mandrel lug 172, and the latch stop 208 engages or contacts the no go down shoulder of the mandrel 176 simultaneously. This reduces or eliminates shuttling of the gas lift valve between the no go up and no go down shoulders of the mandrel during pressure reversals, advantageously making the latch highly reliable.

The collets of FIGS. 25A-25F include axial slots 286 about their circumferences, which allow the collets 280 to collapse as the latch passes the mandrel lug 172 during installation or retrieval. The installation and retrieval forces required for slickline operation of the latches are determined by the stiffness of the collet beams 288 (where the slots 286 define or separate the beams 288) and the angle of engagement of the collet profile with the mandrel lug 172 when secured in place. The stiffness of the collet beams 288 is in turn determined by the number of beams 288, beam profile and thickness, and beam length. Using finite element modeling as a validation tool, by parametric optimization of the above design parameters, a robust and reliable collet sleeve 280 with predictable gas lift valve and latch assembly installation and retrieval forces can be developed.

Language of degree used herein, such as the terms "approximately," "about," "generally," and "substantially" as used herein represent a value, amount, or characteristic close to the stated value, amount, or characteristic that still performs a desired function or achieves a desired result. For example, the terms "approximately," "about," "generally," and "substantially" may refer to an amount that is within less than 10% of, within less than 5% of, within less than 1% of, within less than 0.1% of, and/or within less than 0.01% of the stated amount. As another example, in certain embodiments, the terms "generally parallel" and "substantially parallel" or "generally perpendicular" and "substantially perpendicular" refer to a value, amount, or characteristic that departs from exactly parallel or perpendicular, respectively, by less than or equal to 15 degrees, 10 degrees, 5 degrees, 3 degrees, 1 degree, or 0.1 degree.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims. It is also contemplated that various combinations or sub-combinations of the specific features and aspects of the embodiments described may be made and still fall within the scope of the disclosure. It should be understood that various features and aspects of the disclosed embodiments can be combined with, or substituted for, one another in order to form varying modes of the embodiments of the disclosure. Thus, it is intended that the scope of the disclosure herein should not be limited by the particular embodiments described above.

What is claimed is:

1. A latch for a downhole component, the latch comprising:

a latch stop comprising a no go down shoulder on an outer surface of the latch stop and an undercut at least partially defined by an inner surface of the latch stop, the undercut extending downward from a top surface of the latch stop;

a running head coupled to and extending upward from the latch stop;

a latch body circumferentially disposed about at least a portion of the running head, wherein the latch body is configured to slide axially relative to the running head during installation of the latch such that a lower portion of the latch body slides into the undercut;

a latch ring disposed circumferentially about the latch body; and a cutout in an outer surface of the latch body, wherein as the latch body slides axially into the undercut during installation, the cutout is configured to move into alignment with the latch ring and the latch ring is configured to collapse into the cutout to enable the latch ring to clear a lug of a mandrel into which the latch is installed.

2. The latch of claim 1, wherein the latch ring is disposed adjacent the top surface of the latch stop.

3. The latch of claim 1, wherein the undercut is machined into the top surface of the latch stop.

4. The latch of claim 1, wherein the latch stop comprises a sleeve disposed about a portion of the running head.

5. The latch of claim 4, wherein the latch stop and running head are integrally formed.

6. The latch of claim 4, wherein the running head comprises a base and a post extending upward from the base.

7. The latch of claim 6, wherein the latch stop is coupled to the base of the running head.

8. The latch of claim 6, wherein the running head at least partially defines and bounds the undercut.

9. The latch of claim 1, wherein the undercut is at least partially defined and bounded by an inner surface of the latch stop and an outer surface of the running head.

10. The latch of claim 1, wherein when the latch body slides into the undercut, a clearance is formed between a bottom of the latch body and a base of the undercut.

11. The latch of claim 1, further comprising a shear pin extending transversely through the running head.

12. The latch of claim 11, the latch body further comprising a slot extending axially along a portion of a length of the latch body, and an end of the shear pin disposed in the slot.

13. The latch of claim 12, wherein as the latch body slides axially relative to the running head during installation, the shear pin is configured to slide axially within or relative to the slot.

14. The latch of claim 1, further comprising a spring disposed circumferentially about the latch body and extending axially from a top of the latch ring to a bottom of a latch stopper disposed about the latch body.

15. A method of installing the latch of claim 14 into a mandrel in a wellbore, the method comprising:

sliding the latch body axially such that the lower portion of the latch body slides into the undercut, thereby compressing the spring and allowing the latch ring to collapse into the cutout;

pushing the latch into a pocket of the mandrel until stopped by contact of the no-go down shoulder of the latch stop with a no go down shoulder at a bottom of the pocket; and releasing the latch body such that the spring biases the latch body out of the undercut, thereby pushing the latch ring radially outwardly into the pocket such that upward movement of the latch is stopped by contact of an upper surface of the latch ring with a no go up shoulder at a top of the pocket.

16. A method of retrieving a latch from a mandrel in a wellbore, the method comprising:

contacting the latch, the latch comprising:

a latch stop comprising a no go down shoulder on an outer surface of the latch stop and an undercut at least partially defined by an inner surface of the latch stop, the undercut extending downward from a top surface of the latch stop;

a running head coupled to and extending upward from the latch stop;

a latch body circumferentially disposed about at least a portion of the running head, the latch body comprising a slot extending axially along a portion of a length of the latch body, and the latch body configured to slide axially relative to the running head during installation of the latch such that a lower portion of the latch body slides into the undercut;

a shear pin extending transversely through the running head, an end of the shear pin disposed in the slot; and a latch ring disposed circumferentially about the latch body;

pulling up on the latch body to move the latch body relative to the running head, thereby shearing the shear pin and allowing the latch ring to collapse; and pulling up on the latch such that the latch ring clears a lug of the mandrel.

17. A latch for a downhole component, the latch comprising:

a latch stop comprising a no go down shoulder on an outer surface of the latch stop;

a running head coupled to and extending upward from the latch stop;

a latch body circumferentially disposed about at least a portion of the running head; and a latch ring disposed circumferentially about the latch body and axially adjacent a top of the latch stop, wherein a distance from the no go down shoulder of the latch stop to an upper surface of the latch ring is approximately the same as an axial length of a pocket of a mandrel into which the latch is installed, and wherein when the latch is installed in the mandrel, contact of the no go down shoulder of the latch with a no go down shoulder of the mandrel and contact of the upper surface of the latch ring with a no go up shoulder of the mandrel is configured to prevent or minimize movement of the latch relative to the mandrel during use.

18. The latch of claim 17, wherein during installation, the latch ring remains axially adjacent the top of the latch stop.

* * * * *